US009865416B2

(12) United States Patent
Dirks et al.

(10) Patent No.: US 9,865,416 B2
(45) Date of Patent: Jan. 9, 2018

(54) ELECTRICAL POWER TRANSFER SWITCH

(71) Applicants: Keith Dirks, Sterling, IL (US); Matthew Moeller, Rock Falls, IL (US); Mathew McClelland, Dixon, IL (US)

(72) Inventors: Keith Dirks, Sterling, IL (US); Matthew Moeller, Rock Falls, IL (US); Mathew McClelland, Dixon, IL (US)

(73) Assignee: Hartland Controls, LLC, Rock Falls, IL (US)

( * ) Notice: Subject to any disclaimer, the term of this patent is extended or adjusted under 35 U.S.C. 154(b) by 0 days.

(21) Appl. No.: 15/135,023

(22) Filed: Apr. 21, 2016

(65) Prior Publication Data

US 2017/0309423 A1 Oct. 26, 2017

(51) Int. Cl.

| | |
|---|---|
| ***H01H 5/00*** | (2006.01) |
| ***H01H 21/36*** | (2006.01) |
| ***H01H 21/22*** | (2006.01) |

(52) U.S. Cl.

CPC ..... *H01H 21/36* (2013.01); *H01H 21/22* (2013.01); *H01H 2201/022* (2013.01); *H01H 2203/036* (2013.01); *H01H 2205/002* (2013.01); *H01H 2235/01* (2013.01)

(58) Field of Classification Search

CPC ..... H01H 2300/018; H01H 9/26

USPC ..... 200/335, 1 R, 400, 401; 307/64

See application file for complete search history.

(56) References Cited

U.S. PATENT DOCUMENTS

| | | | |
|---|---|---|---|
| 3,185,790 | A | 5/1965 | Salerno |
| 3,646,355 | A | 2/1972 | Ireland et al. |
| 3,936,782 | A | 2/1976 | Moakler et al. |
| 4,021,678 | A | 5/1977 | Moakler et al. |
| 4,157,461 | A | 6/1979 | Wiktor |
| 4,295,053 | A | 10/1981 | Kovatch et al. |
| 4,297,551 | A | 10/1981 | Ronk |
| 4,398,097 | A | 8/1983 | Schell et al. |
| 4,590,387 | A | 5/1986 | Yoshida et al. |
| 4,804,933 | A | 2/1989 | Becker et al. |
| 4,937,403 | A | 6/1990 | Minoura et al. |
| 4,999,598 | A | 3/1991 | Jannesari et al. |
| 5,023,469 | A | 6/1991 | Bassett et al. |
| 5,070,252 | A | 12/1991 | Castenschiold et al. |
| 5,164,694 | A | 11/1992 | DeVault et al. |
| 5,289,146 | A | 2/1994 | Plumeret et al. |
| 5,638,948 | A | 6/1997 | Sharaf et al. |
| 5,721,449 | A | 2/1998 | Panuce |
| 5,914,467 | A | 6/1999 | Jonas et al. |
| 6,015,959 | A | 1/2000 | Slepian et al. |

(Continued)

FOREIGN PATENT DOCUMENTS

| | | |
|---|---|---|
| CN | 202736782 U | 2/2013 |
| CN | 203659675 U | 6/2014 |

(Continued)

*Primary Examiner* — Vanessa Girardi

(74) *Attorney, Agent, or Firm* — Cohen & Grigsby, PC

(57) ABSTRACT

A modular transfer switch (22) and actuator (20) wherein multiple transfer switches are connectable in linear arrangement with the actuator such that the actuator controls the position of all of the transfer switches. Each of the transfer switches (22) includes a contact assembly (48) that converts over-rotation of the drive linkage (26) in the transfer switch to added pressure between the load contacts and the power contacts in the contact assembly.

24 Claims, 18 Drawing Sheets

(56) References Cited

U.S. PATENT DOCUMENTS

| | | | | |
|---|---|---|---|---|
| 6,121,897 | A | 9/2000 | Flegel | |
| 6,194,675 | B1 | 2/2001 | Greer | |
| 6,384,350 | B1 | 5/2002 | Shincovich et al. | |
| 6,534,737 | B1 | 3/2003 | Rademacher et al. | |
| 6,538,223 | B1 * | 3/2003 | Yoshida | H01H 21/42 200/1 R |
| 6,577,216 | B2 | 6/2003 | Turner et al. | |
| 6,590,481 | B2 | 7/2003 | Turner et al. | |
| 6,604,277 | B2 | 8/2003 | Schultz et al. | |
| 6,693,248 | B1 | 2/2004 | Schultz | |
| 6,765,157 | B2 | 7/2004 | Rademacher et al. | |
| 6,801,109 | B2 | 10/2004 | Simms | |
| 6,815,624 | B2 | 11/2004 | Schultz | |
| 6,849,811 | B1 | 2/2005 | Heflin et al. | |
| 6,861,930 | B2 | 3/2005 | Simms et al. | |
| 6,940,032 | B2 | 9/2005 | Sirajtheen et al. | |
| 7,030,514 | B2 | 4/2006 | Wareham et al. | |
| 7,115,823 | B1 | 10/2006 | Anaya-Burgos | |
| 7,196,434 | B2 | 3/2007 | Zhou et al. | |
| RE40,161 | E | 3/2008 | Panuce | |
| 7,557,683 | B1 | 7/2009 | Wang | |
| 7,898,372 | B2 | 3/2011 | Melchionne | |
| 8,354,604 | B2 | 1/2013 | Park et al. | |
| 8,519,285 | B2 | 8/2013 | Park et al. | |
| D691,566 | S | 10/2013 | Hashimoto et al. | |
| D692,396 | S | 10/2013 | Hashimoto et al. | |
| 8,658,923 | B2 | 2/2014 | Weber et al. | |
| 8,732,361 | B2 | 5/2014 | Donaghey | |
| 8,735,754 | B2 | 5/2014 | Yoshida et al. | |
| 9,068,935 | B2 | 6/2015 | Dorman et al. | |
| 9,142,365 | B2 | 9/2015 | Moroz et al. | |
| 2005/0150754 | A1 * | 7/2005 | Sirajtheen | H01H 5/06 200/400 |

FOREIGN PATENT DOCUMENTS

| | | | |
|---|---|---|---|
| CN | 205069528 | U | 3/2016 |
| DE | 102009033541 | | 1/2011 |
| EP | 0335002 | A2 | 10/1989 |
| EP | 1189251 | A2 | 3/2002 |

* cited by examiner

ELECTRICAL POWER TRANSFER SWITCH

BACKGROUND OF THE INVENTION

Field of the Invention

The presently disclosed invention relates to electrical switches and, more particularly, electrical power transfer switches.

Discussion of the Prior Art

Electrical power transfer switches have been used to transfer an electrical load from one power source to another power source. Frequently, such switches are used in emergency panels that transfer incoming line power to an emergency generator or other source at times when the standard power source has been interrupted or failed due to inclement weather or other emergency conditions such as flooding.

In the prior art, transfer switches have been developed to reliably and automatically switch industrial and commercial loads such as factories, shopping malls and hospitals to an alternate power source in the event of an electrical power failure. Many examples are known in the prior art.

Such transfer switches have worked well, but their cost and size did not lend their application to light commercial or residential use. Accordingly, there was a need in the prior art for electrical power transfer switches that would meet all UL and other applicable standards for reliability and safety, but that were less costly and more adaptable for use in lighter duty applications such as in small businesses and homes.

Some power transfer switches that have been used in the past have been relatively difficult to assemble. Further, their design is not readily adaptable to modification or multiple application. Examples are shown in U.S. Pat. Nos. 6,538,223 and 8,735,754. U.S. Pat. No. 6,538,223 describes a transfer switch wherein contacts to a load can be toggled between oppositely opposed supply contacts that are connected to respective power supplies to switch from one power supply to another. The load contacts are located on opposite faces of an arm that is moveable between the two power contacts to electrically connect the load contacts with one of the power contacts. The arm is connected to a cross bar that is reversibly rotatable through an arc in clockwise and counterclockwise directions to move the arm into one position where the load contacts engage the contacts of the first power source and a second position in which the load contacts engage the contacts of the second power source. The cross bar includes two extending members that are connected to respective plungers of two solenoids such that the angular position of the cross bar is controlled by extension and retraction of the solenoid plungers.

Transfer switches are subject to a well-known phenomenon known as "blow open" wherein opposing electrical fields of the load contacts and the supply contacts tend to be forced apart as the contacts are brought into proximity. To overcome this difficulty, the cross bar in U.S. Pat. No. 6,538,223 is caused to over-rotate the end points of the arc that is necessary to bring the load contacts and the power contacts together and the load contacts are spring loaded to mechanically absorb the interference between the load contacts and the supply contacts. In the structure of U.S. Pat. No. 6,538,223, a spring biases the arm against a stop. That design causes the arm to develop separate fulcrum points (and therefore different closing force) between the load contacts and the supply contacts depending on the angular direction of the cross bar.

U.S. Pat. No. 8,735,754 shows an alternative mechanism for the spring bias of the load contacts against the supply contacts. In that patent, the spring bias force for the load contacts is directed along the plane of the arm so that the arm rocks across the center axis of the spring by the degree of over-rotation.

It has been found that prior art designs such as shown in U.S. Pat. Nos. 6,538,223 and 8,735,754 were limited to specific applications according to their particular design. Also, it has been found that the assembly of transfer switches according to those designs was somewhat difficult and costly. For example, in the designs of U.S. Pat. Nos. 6,538,223 and 8,735,754 the springs that spring bias the load contacts against the supply contacts have a relatively high spring force so that compressing the springs to form a finished assembly was difficult and required special tools or jigs.

Accordingly, there was a need in the prior art for a transfer switch that could be assembled easily and without special tools and that also was adaptable to various applications.

SUMMARY OF THE INVENTION

In accordance with the presently disclosed invention, an actuator for controlling the mechanical position of an electrical device includes a frame that defines a pivot pin therein. A pivot arm having a longitudinal axis and a slot with a major axis that is parallel to the longitudinal axis is connected to a rotatable member that serves as a driver. The rotatable member is connectable directly to an electrical device such as a transfer switch in which the device has different states of operation depending on mechanical states of the device. The rotatable member of the actuator defines a longitudinal axis and is pivotal about said longitudinal axis with respect to said frame in both clockwise and counter-clockwise directions. The rotatable member also has a radial extension that is pivotally connected to the pivot arm. The pivot pin of the frame extends through the slot of the pivot arm such that a change in the angular position of the pivot arm with respect to said frame in one angular direction causes the rotatable member to pivot in the opposite angular direction. An extension spring has one end that is connected to the rotatable member and an opposite end that is connected to the pivot arm such that the extension spring biases the pivot arm toward the end positions of the travel arc of the pivot arm.

Preferably, the spring force of the extension spring is greater at times when said pivot arm is angularly positioned between the end positions of the travel arc in comparison to the spring force at times when said pivot arm is located at the end positions.

Also preferably, the actuator includes a linear motor such as composed of two opposing solenoids that are secured in fixed relationship to the frame. The linear motor has an armature that moves linearly between a first and second end positions and is connected to a shuttle bracket to move the shuttle bracket between first and second positions with respect to the frame in response to the movement of the armature. The shuttle bracket is connected to the pivot arm such that the linear motor is used to power movement of the rotatable member through movement of the shuttle bracket and the pivot arm.

Also, when the electrical device is a transfer switch, it includes a spool that is pivotal with respect to a frame of the switch in both clockwise and counter-clockwise angular directions. The spool is connectable to the rotatable member of the actuator such that it can be driven by the actuator. The spool also is connectable to adjacent transfer switches of the same design such that a linear array of switches can be assembled in modular fashion with all of said switches operating synchronously and controlled by the same actuator. The transfer switch further includes a load contact that is connected to a contact arm that extends radially from the spool such that the load contact is movable between end points of an arc in response to corresponding angular movement of the spool. The load contact is moveable between first and second source or power contacts that are located at a given radius and angular position with respect to the spool so as to engage the load contact when the spool is an a given angular position.

In some cases, the transfer switch also includes a contact assembly wherein compression springs are located on opposite sides of the contact arm and transversely from a respective power contact. Alternative ones of the compression springs are compressed when the spool is at corresponding end positions of its arc of angular movement.

In another preferable embodiment of the disclosed invention, the contact arm is biased by a contact assembly that includes at least two flat magnets that are connected to the contact arm and at least two U-shaped magnets. The flat magnets cooperate with respective ones of the U-shaped magnets when the load contact is in contact with one of the power contacts to produce an attractive force between the flat magnet and the U-shaped magnet in response to electrical current flow in the contact arm. Preferably, the contact arm defines first and second branches with each branch having a flat magnet attached thereto. Also preferably, the contact arm is connected to the spool by a rocking mounting that includes a holder and compression springs that oppose transverse sides of the contact arm. In addition, the rocking mounting can define a gap between the rocking mounting and the contact arm while also defining a land that is located between the rocking mounting and the contact arm and that is adjacent to the gap. In such embodiment, the gap closes when the spool is at an angular position that extends outside the angular position of the spool that corresponds to contact between the load contact and the power contact.

Other objects, advantages and improvements of the presently disclosed invention will become apparent to those skilled in the art as the following presently preferred embodiments thereof proceeds.

BRIEF DESCRIPTION OF THE DRAWINGS

A presently preferred embodiment of the disclosed invention is shown and described in connection with the accompanying drawings wherein.

DESCRIPTION OF A PRESENTLY PREFERRED EMBODIMENT

Figure 1:
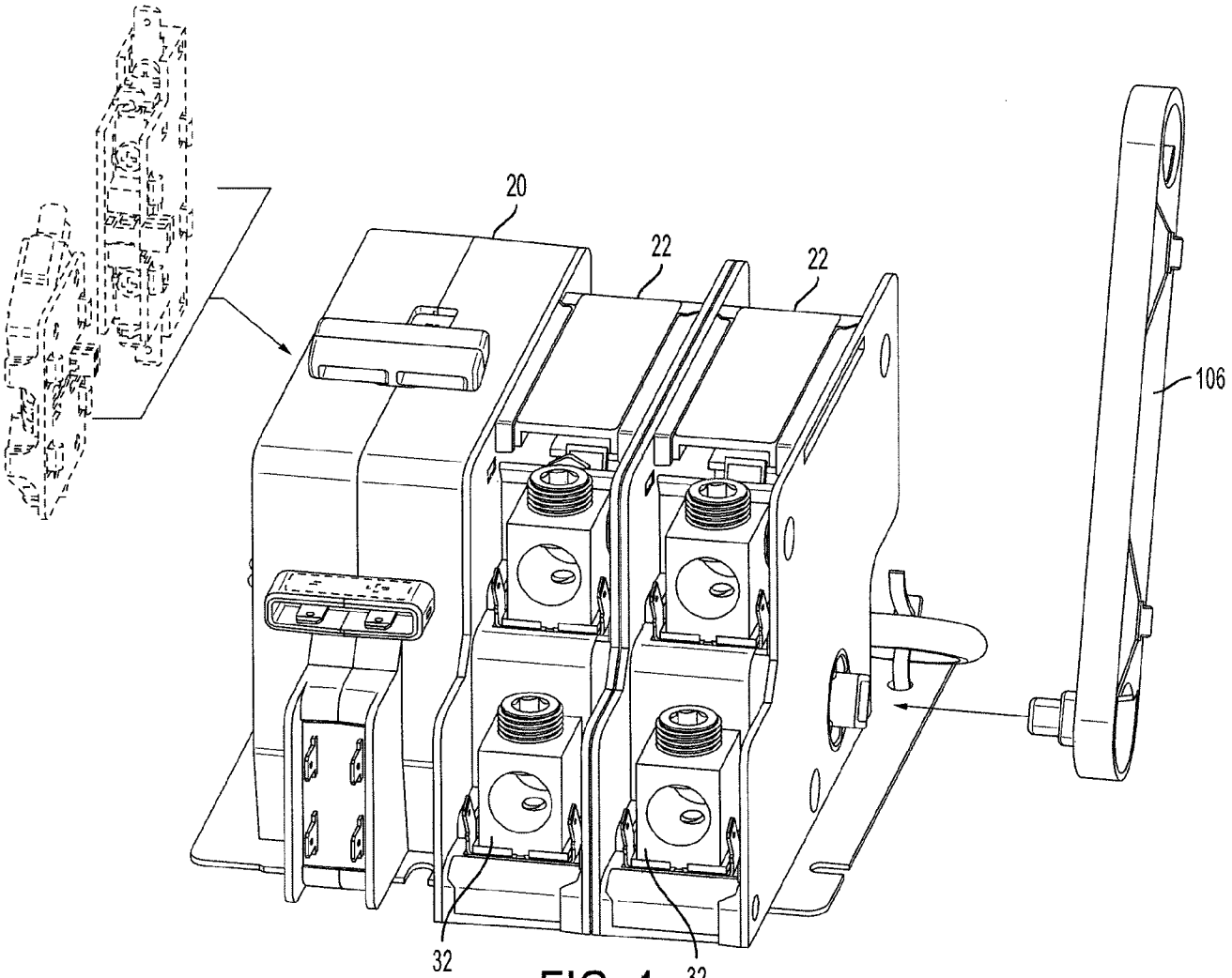
FIG. 1 is a perspective view of the disclosed actuator in combination with two disclosed transfer switches.
Figure 2:
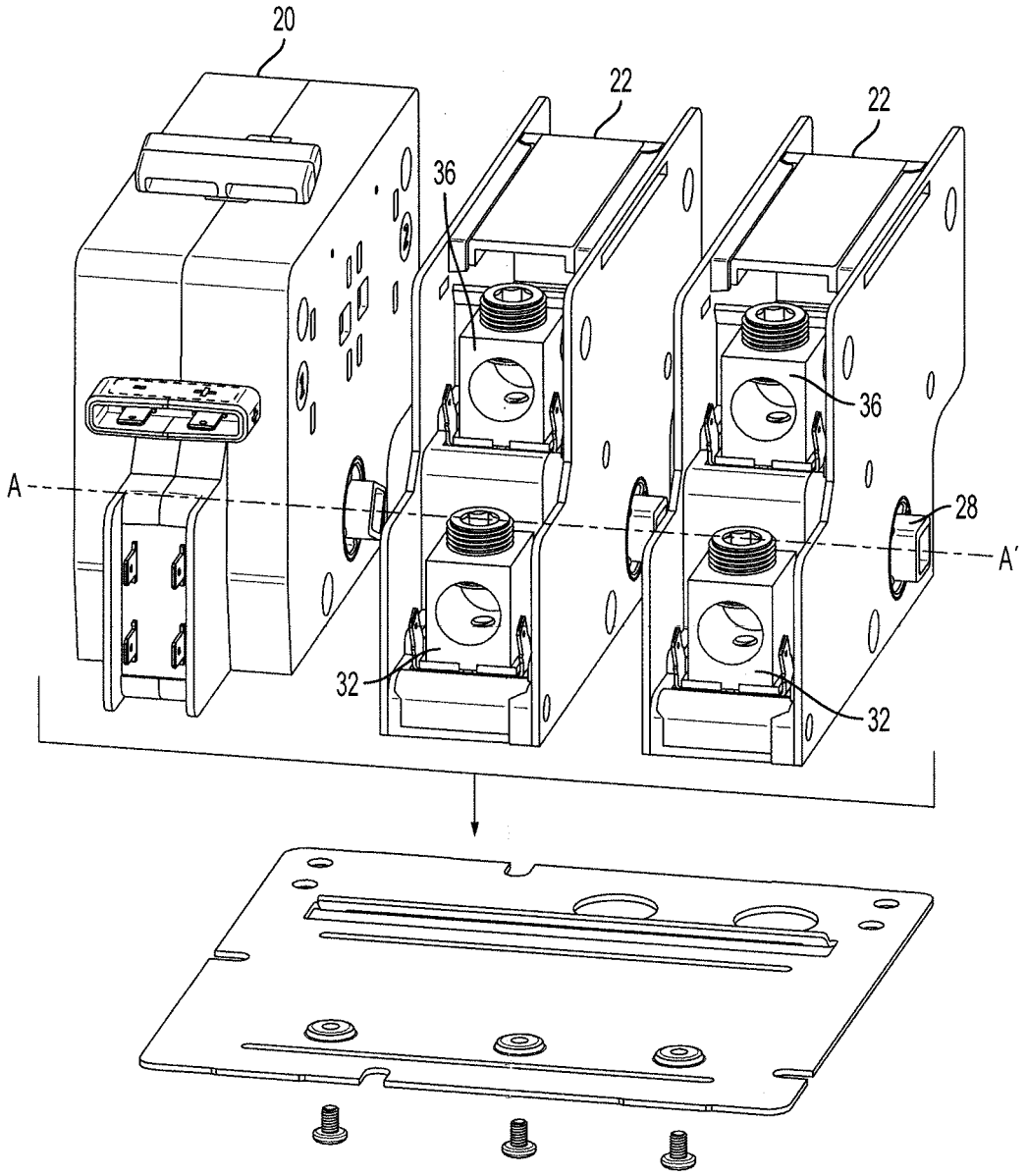
FIG. 2 is a partially exploded view of the actuator and transfer switches that are shown in FIG. 1.
Figure 3:
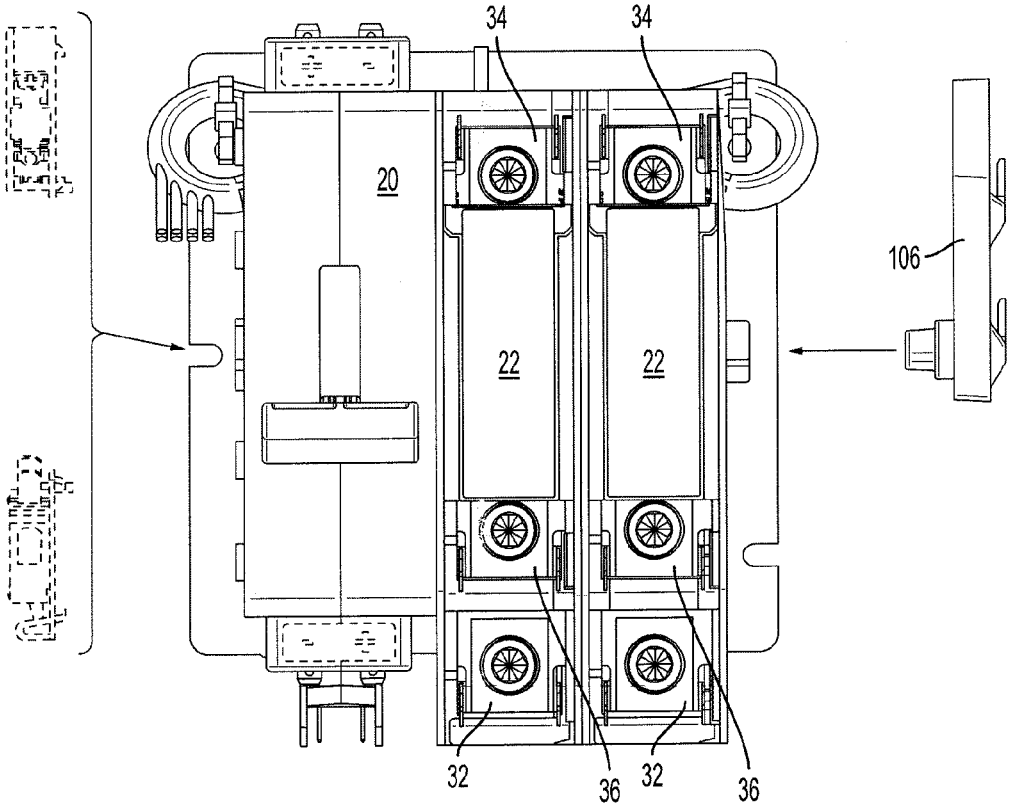
FIG. 3 is a top plan view of the actuator and transfer switches that are shown in FIG. 1.
Figure 4:
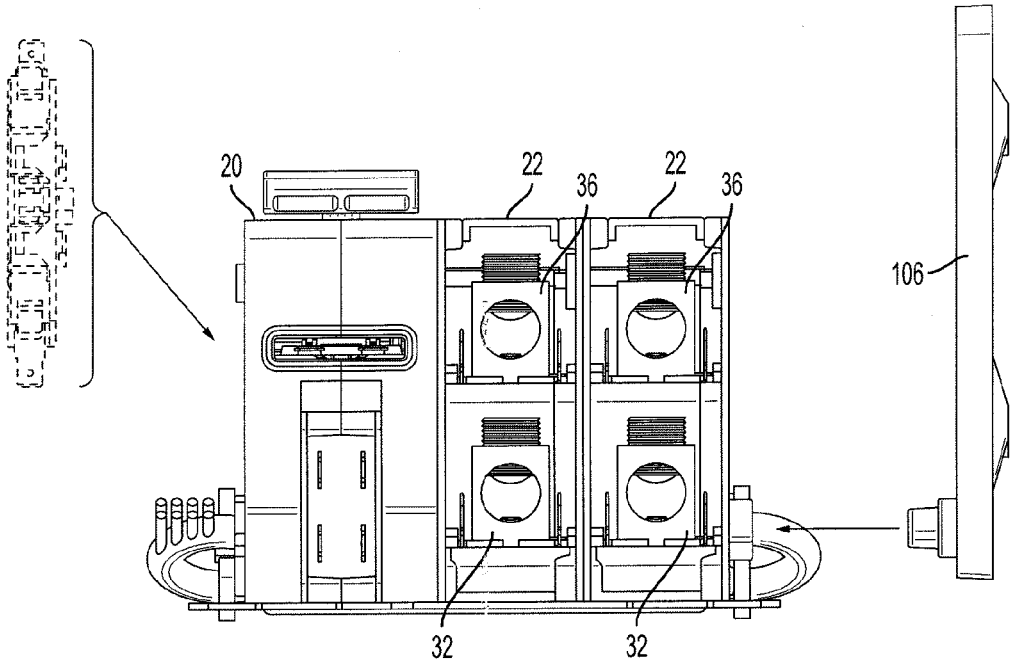
FIG. 4 is a front elevation view of the actuator and transfer switches that are shown in FIG. 1.
Figure 5:
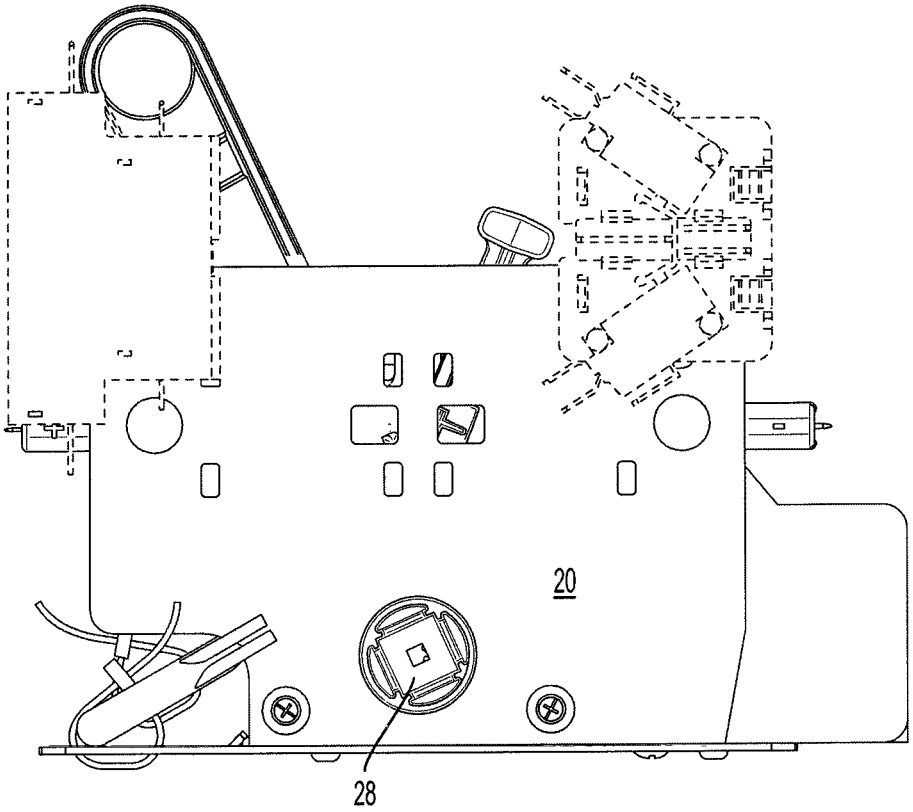
FIG. 5 is a right side elevation view of the actuator that is shown in FIG. 1.
Figure 6:
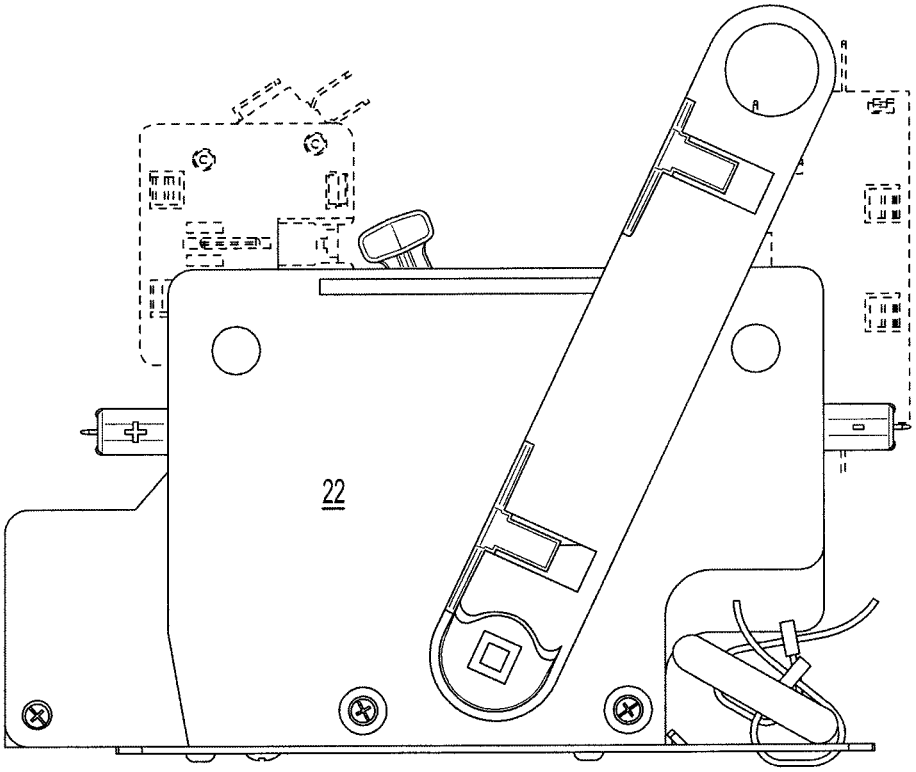
FIG. 6 is a left side elevation view of the actuator that is shown in FIG. 1 with a manual activation handle added thereto.
Figure 7:
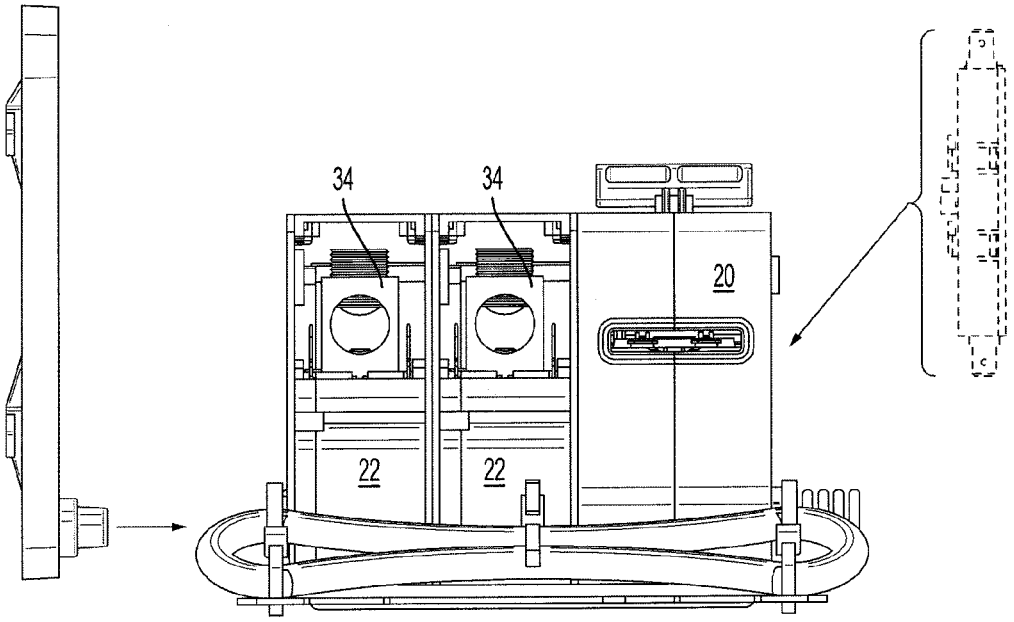
FIG. 7 is a rear elevation view of the actuator and transfer switches that are shown in FIG. 1.
Figure 8:
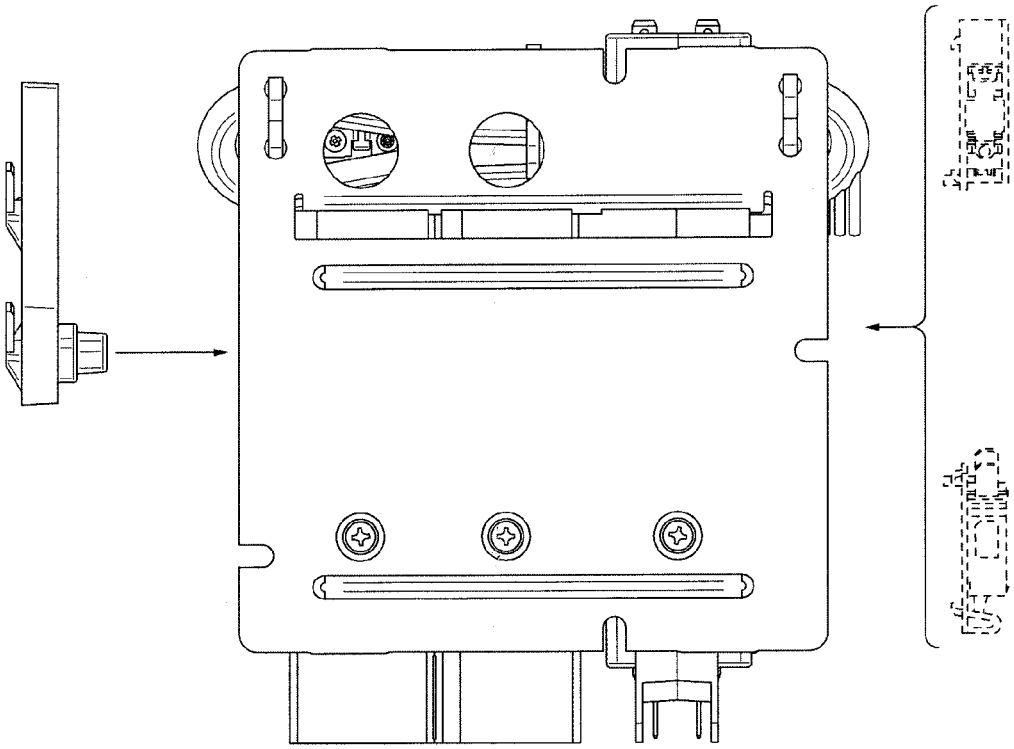
FIG. 8 is a bottom view of the actuator and transfer switches that are shown in FIG. 1.
Figure 9:
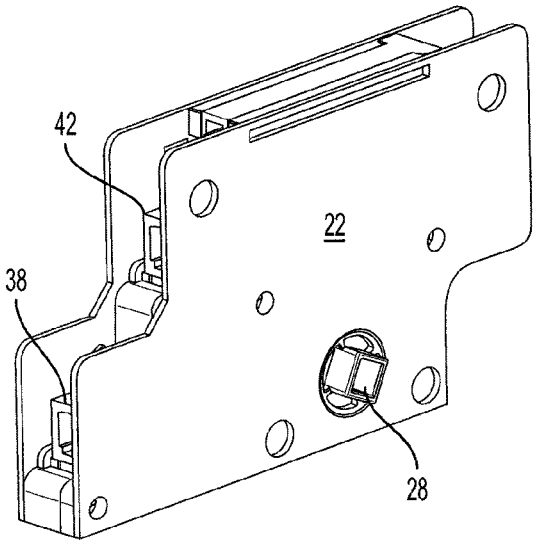
FIGS. 9 and 10 are perspective views of the transfer switches that, are shown in FIG. 1, but the transfer switch of FIG. 9 has an alternative lug assembly.
Figure 10:
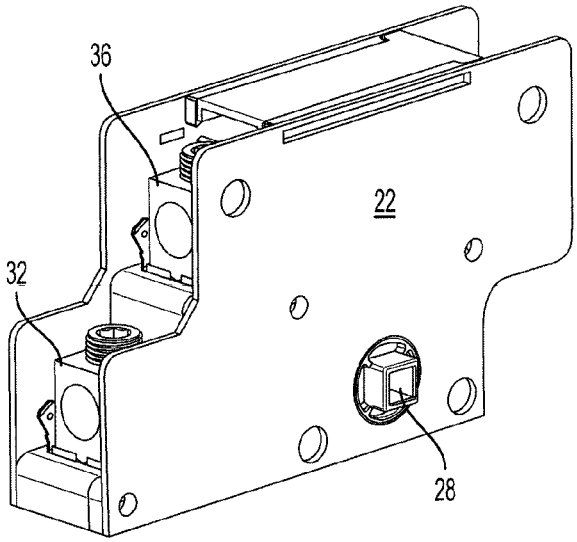
Figure 11:
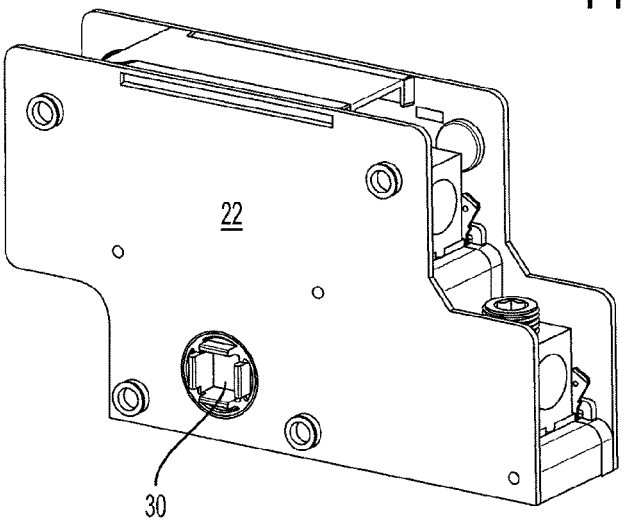
FIG. 11 is a reverse perspective view of the transfer switch that is shown in FIG. 10.

FIGS. 1-8 show a presently preferred embodiment of the disclosed invention that includes an actuator 20 and at least one transfer switch 22. Preferably, the disclosed invention includes more than one transfer switch 22 that are connected together in side-by-side relationship to form a linear array.

The actuator 20 controls the angular position of a driver 24 that is connected to the transfer switch 22 that is adjacent to the actuator 20. Each of the transfer switches 22 include respective drive linkage 26 that are connected together longitudinally along a common axis of rotation A-A' such that the position of all of the transfer switches 22 is controlled by the position of the driver 24 in the actuator 20.

The drive linkage 26 in each of the transfer switches 22 is of a common design such that it can be connected together longitudinally in any order within the linear array. Preferably, drive linkage 26 has a first end such as a male end 28 and a second end such as a female end 30 that is engagable with the male end 28. Also preferably, one of the first or second ends 28, 30 engages with the end of driver 24 so that any transfer switch 22 is connectable to driver 24.

Transfer switches 22 control the connection of electrical power between a load and one or more alternative power sources. As hereafter more fully explained, when actuator 20 is commanded to cause driver 24 to pivot in a clockwise or counter-clockwise direction, driver 24 causes drive linkage 26 to also pivot and transfer electrical contacts associated with the load from one power source to another power source.

Figure 12:
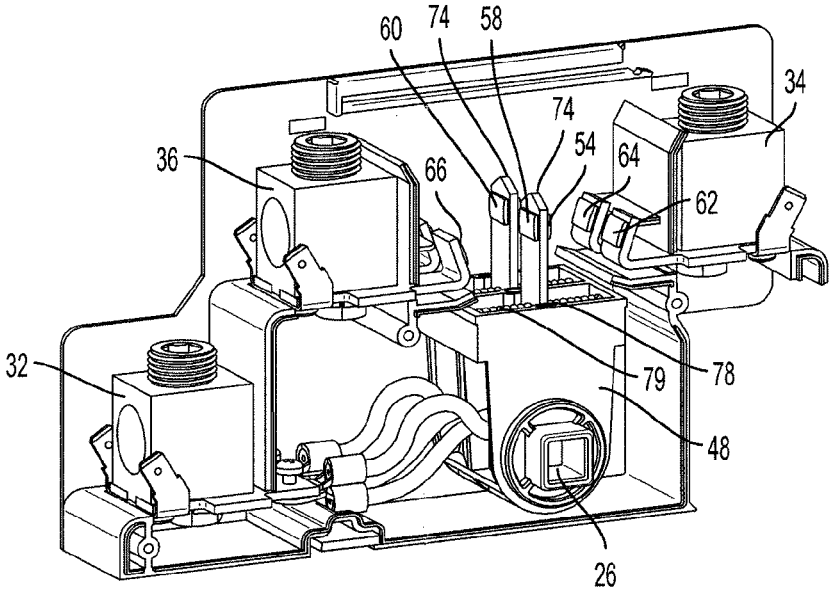
FIG. 12 is a perspective view of a transfer switch similar to that shown in FIG. 10 but with a double pole arrangement and with a portion of the cover removed to better disclose the features therein.
Figure 13:
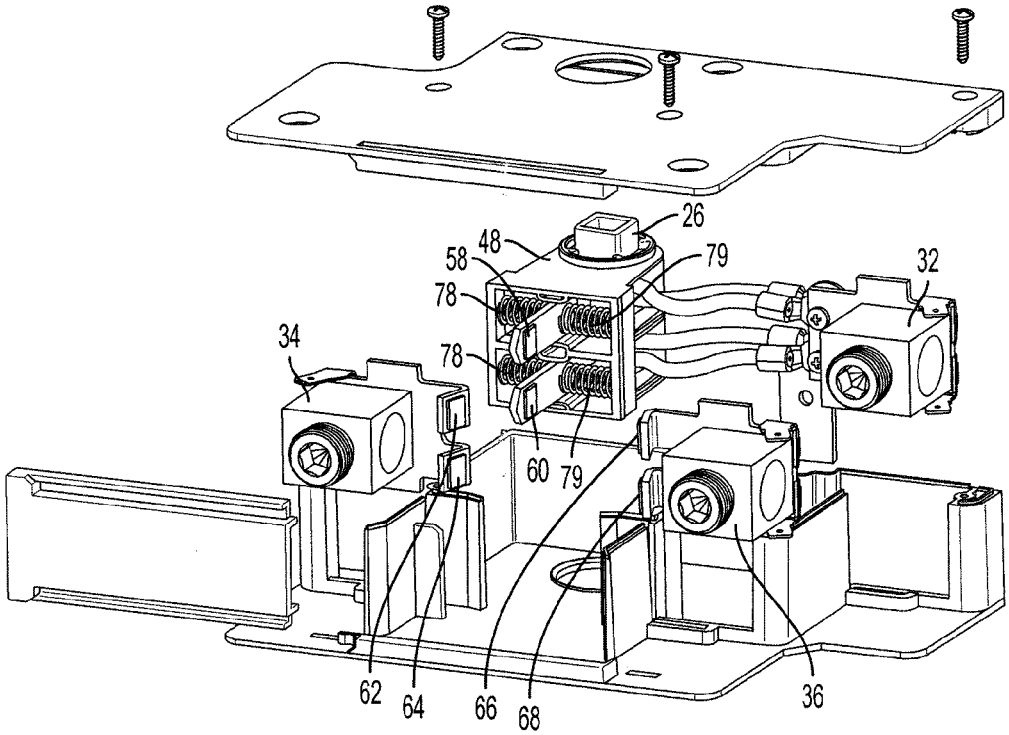
FIG. 13 is a partially exploded perspective of the transfer switch that is shown in FIG. 12 with the transfer switch oriented on its side.
Figure 14:
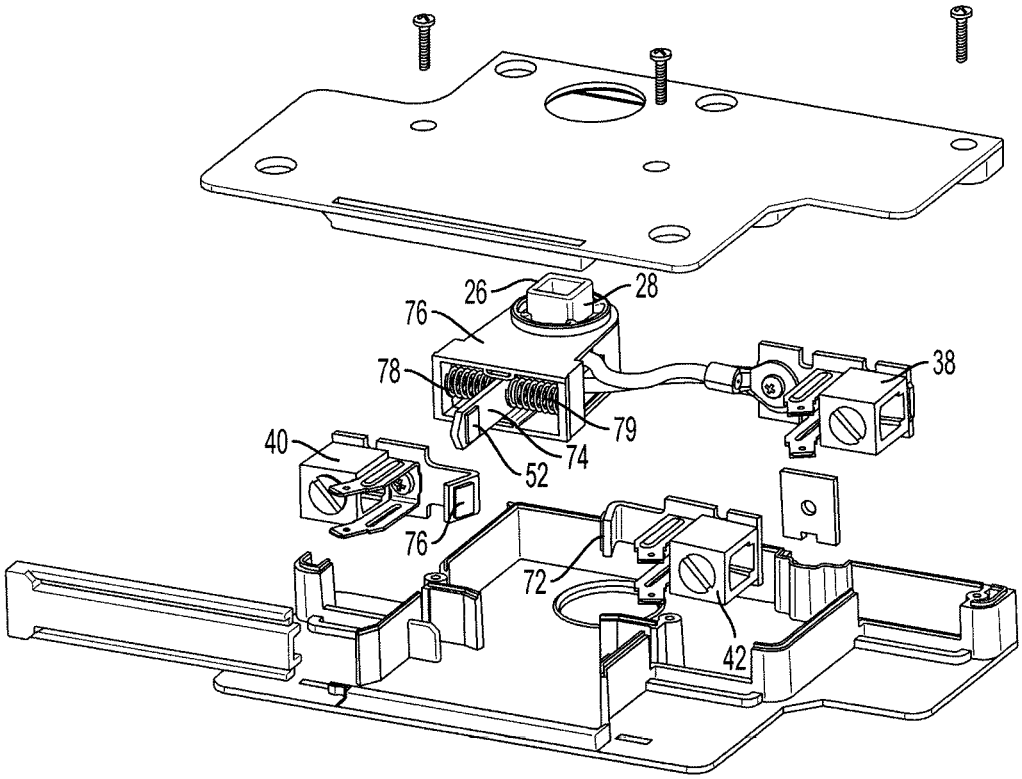
FIG. 14 is a partially exploded perspective view of the transfer switch that is shown in FIG. 9 with the transfer switch oriented on its side.
Figure 15:
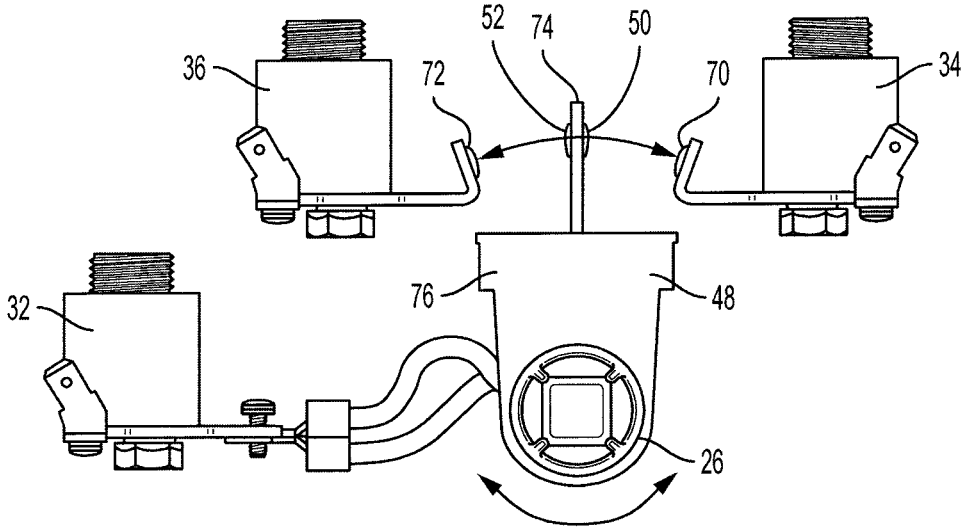
FIG. 15 is a relational diagram showing the lug assemblies of the transfer switch that is shown in FIG. 10.
Figure 16:
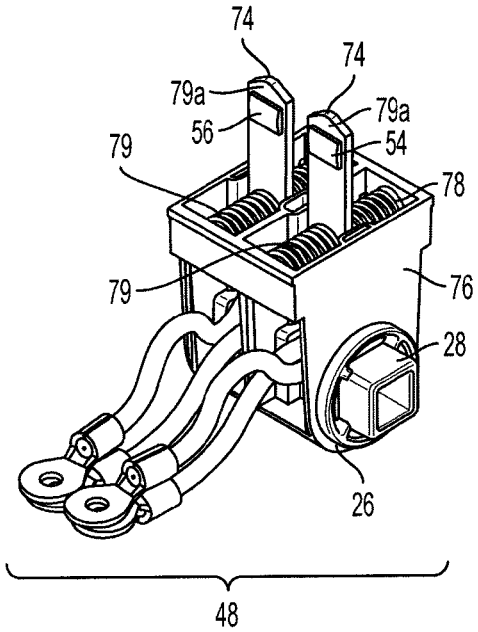
FIG. 16 is a perspective view of the two pole contact assembly that is included in the transfer switch of FIGS. 12 and 13.
Figure 18:
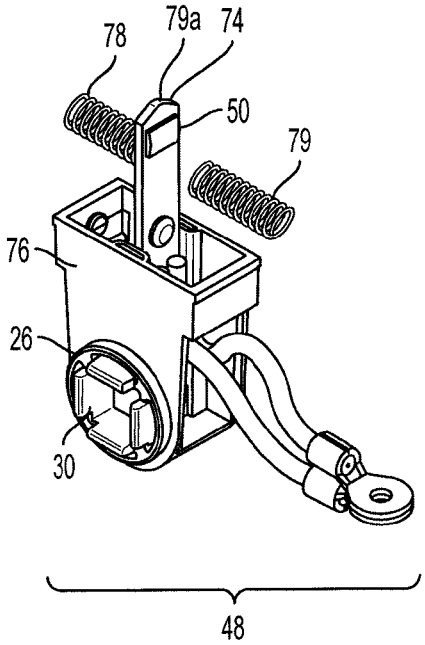
FIG. 18 is a perspective view of the single pole contact assembly that is included in the transfer switch of FIG. 14.
Figure 17:
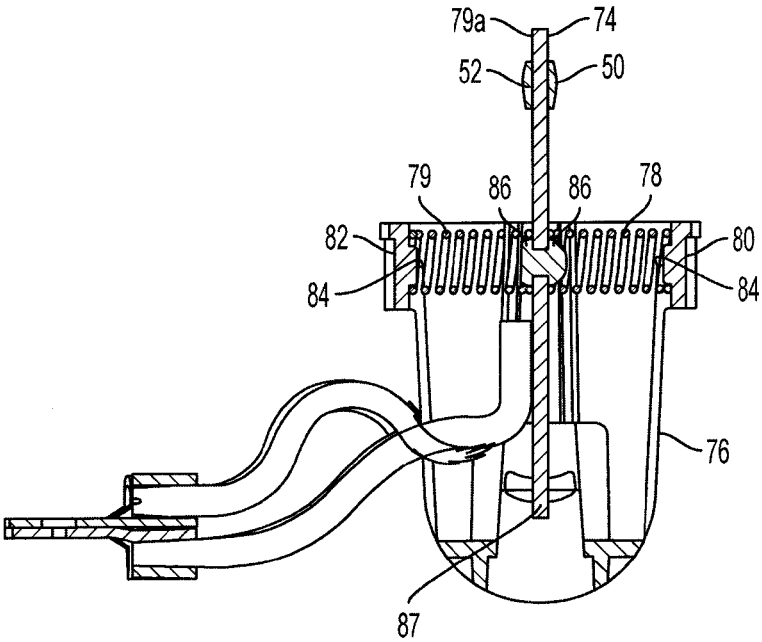
FIG. 17 is a cross sectional view of the contact assembly that is included in the relational diagram of FIG. 15.
Figure 19:
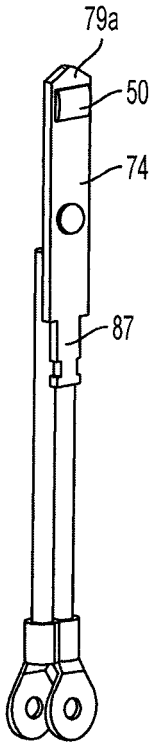
FIG. 19 is a perspective view of the contact arm that is included in the contact assembly that is shown in FIGS. 17 and 18.
Figure 20:
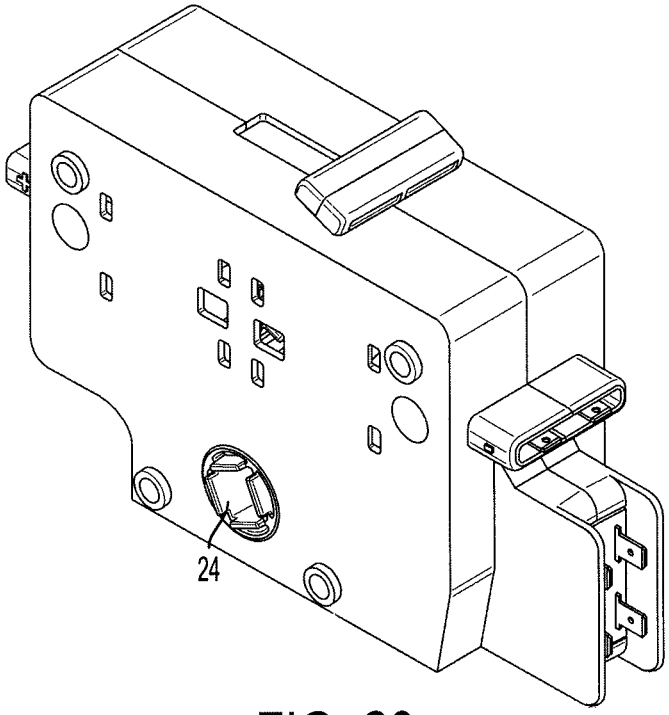
FIG. 20 is a perspective view of the actuator that is shown in FIG. 1.
Figure 21:
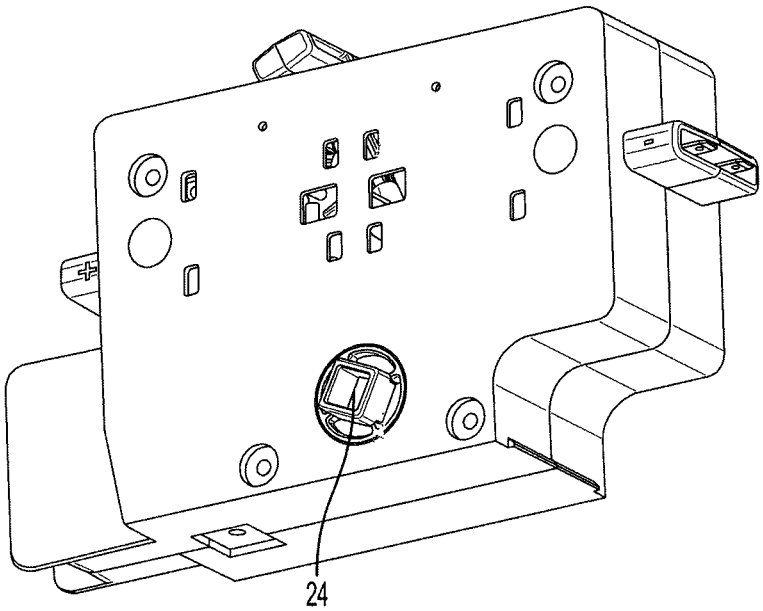
FIG. 21 is a reverse perspective view of the actuator that is shown in FIG. 20.

FIGS. 12-15 show the electrical connections through transfer switch 22 in greater detail. Transfer switch 22 includes a load terminal such as lug assembly 32 and two power terminals such as lug assemblies 34 and 36. Alternative terminals such as quick connect terminals 38, 40 and 42 that are specifically shown in FIG. 14 also can be used. The load terminal such as lug assembly 32 is electrically connected to load contacts that are included in a contact assembly 48. Contact assembly 48 can include single pole load contacts 50, 52 such as shown in FIGS. 14 and 15, or multi-pole load contacts 54, 56 and 58, 60 such as shown in FIGS. 12, 13 and 16.

Alternative power terminals such as lug assemblies 34, 36 are connected to respective electric power supplies (not shown). Lug assembly 34 also is connected to at least a first power contact. Lug assembly 36 also is connected to at least a second power contact. The multi-pole contact assembly 48 shown in FIGS. 12 and 13 includes first source or power contacts 62, 64 and second source or power contacts 66, 68. The single pole contact assembly shown in FIGS. 14 and 15 includes first source or power contact 70 and second source or power contact 72.

As more specifically described in connection with FIGS. 16-19, the contact assembly includes one or more contact arms 74 that are connected to the drive linkage 26 of the transfer switch 22. The contact arms 74 support the load contacts and pivot in accordance with the movement of the drive linkage 26 so that angular movement of the drive linkage corresponds to angular movement of contact arms 74. The load terminal can be connected to either of the power terminals by swinging the contact arms 74 through an arc so as to bring the load contacts into physical contact with the power contacts associated with the respective power terminal. The end points of the arc are defined by the angular position of the power contacts with respect to the contact arms and the axis of rotation of A-A' of drive linkage 26.

The contact assembly 48 suspends contact arms 74 so as to overcome the "blow open" phenomenon observed in closing electrical contacts that was discussed previously herein. The structure of contact assembly 48 allows the drive linkage 26 to pivot past the end points of the arc at which the geometry of the contact assembly 48 causes load contacts 54, 56 and 58, 60 or 50, 52 to contact power contacts 62, 64 and 66, 68 or 70, 72 at times when the transfer switch is in a de-energized state and there are no "blow open" conditions. The excess rotation or pivoting of the drive linkage 26 beyond the angular position at which, in a de-energized state, the load contacts would first contact the opposing power contacts at the end of the arc causes a mechanical interference between the load contacts and the power contacts. Contact assembly 48 converts such mechanical interference to increased closing force between the load contacts and the power contacts so as to avoid blow open conditions.

Referring to FIGS. 16-19, the contact assembly 48 may include a frame 76 that is mounted on or incorporates drive linkage 26 of transfer switch 22 such that frame 76 is pivotal according to the angular movement of the drive linkage. Contact arm 74 may be maintained in frame 76 by opposing springs 78, 79. Each of springs 78, 79 extend between a wall of frame 76 and contact arm 74. One spring 78 extends between a first wall 80 of frame 76 and contact arm 74. The opposing spring 79 extends between a second wall 82 of frame 76 that is transverse to first wall 80 and contact arm 74. Thus, springs 78, 79 bear on opposite, transverse sides of contact arm 74 and maintain contact arm 74 in compression between transverse walls 80, 82 of frame 76. Load contacts 50, 52 of single pole contact assembly 48 (FIGS. 17 and 18) or load contacts 54, 56 and 58, 60 of multi-pole contact assembly 48 (FIGS. 12, 13 and 16) are located on opposite sides of the distil end 79*a* of contact arms 74. Preferably, walls 80, 82 and contact arms 74 are provided with respective retention features such as mounds 84, 86 over which the ends of springs 78, 79 are centered to maintain the location of the ends of springs 78, 79 on walls 80, 82 and contacts arm 74.

The opposing springs 78, 79 tend to maintain contact arm 74 in a position wherein the contact arm is generally normal to the center axis of springs 78, 79 at times when the load contacts are separated from the power contacts. The proximate end 87 of contact arm 74 that is opposite the distal end 79*a* of contact arm 74 where the load contacts are secured is a free end that is unsecured to contact assembly 48. When the load contacts on contact arm 74 engage the power contacts on the frame of transfer switch 22, contact arm 74 tends to pivot in an angular direction with respect to frame 76 that is opposite to the angular direction in which drive linkage 26 and frame 76 pivot with respect to the frame of transfer switch 22.

The angular pivoting of contact arm 74 with respect to frame 76 converts the over-rotation of drive linkage 26 and contact assembly 48 into increased force against the load contacts against the power contacts. For example, as the contact assembly 48 shown in FIG. 15 is pivoted in a clockwise direction past the angular position where single pole contact 50 engages first power contact 70, contact arm 74 will pivot in a counter-clockwise direction with respect to frame 76 of contact assembly 48. The counter-clockwise pivot of contact arm 74 causes compression of spring 79 and extension of spring 78 that results in an increased force of contact 50 against power contact 70 due to the unbalanced opposing forces of springs 78, 79. Conversely, if the contact assembly shown in FIG. 15 is pivoted in a counter-clockwise direction past the annular position where single pole contact 52 engages second power contact 72, contact arm 74 will pivot in a clockwise direction with respect to frame 76 of contact assembly 48. The clockwise pivot of contact arm 74 causes compression of spring 78 and extension of spring 79 that results in an increased force of contact 52 against power contact 72 due to the unbalanced opposing forces of springs 78, 79.

In the preferred embodiment, the angular position of transfer switch 22 can be manually controlled by a handle 106 that is connectable to an end of drive linkage 26 as shown in FIGS. 3-8 and 31.

FIGS. 20-24 show a presently preferred embodiment of actuator 20 that drives transfer switch 22. Actuator 20 includes a frame 88 that defines a pivot pin 90 that extends from and is fixed to frame 88. Actuator 20 further includes a pivot arm 92 that defines a longitudinal axis B-B' and a slot 94. Slot 94 has a major axis C-C' that is parallel to the longitudinal axis B-B' of pivot arm 92.

Figure 24:
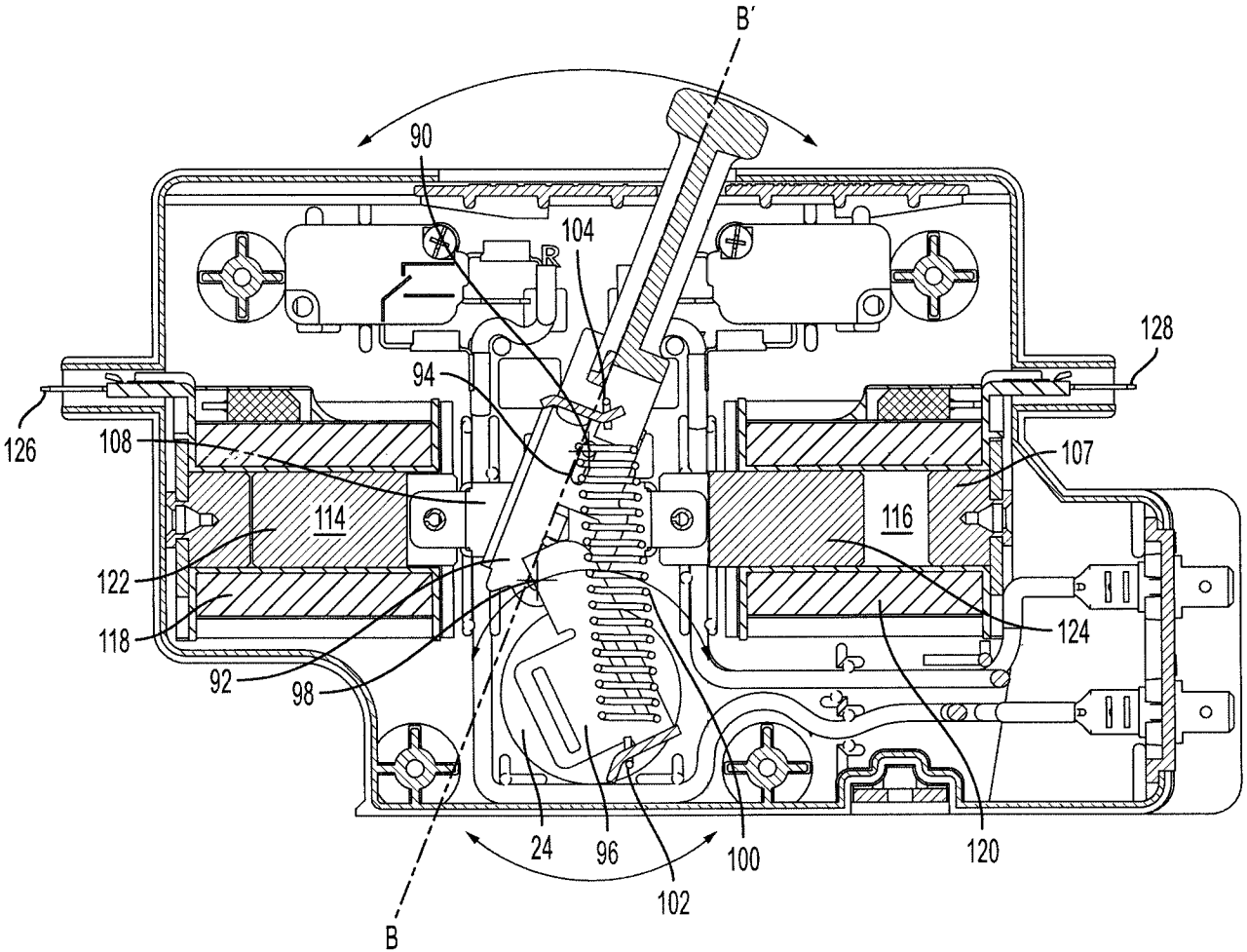
FIG. 24 is a cross-section of the actuator shown in FIG. 22.

Actuator 20 further includes a rotatable member such as driver 24 that is secured to frame 88 such that it is pivotal with respect to frame 88 about the longitudinal axis A-A' that is defined by driver 24. As shown in FIG. 24, driver 24 is pivotal in both clockwise and counter-clockwise angular directions.

Figure 25:
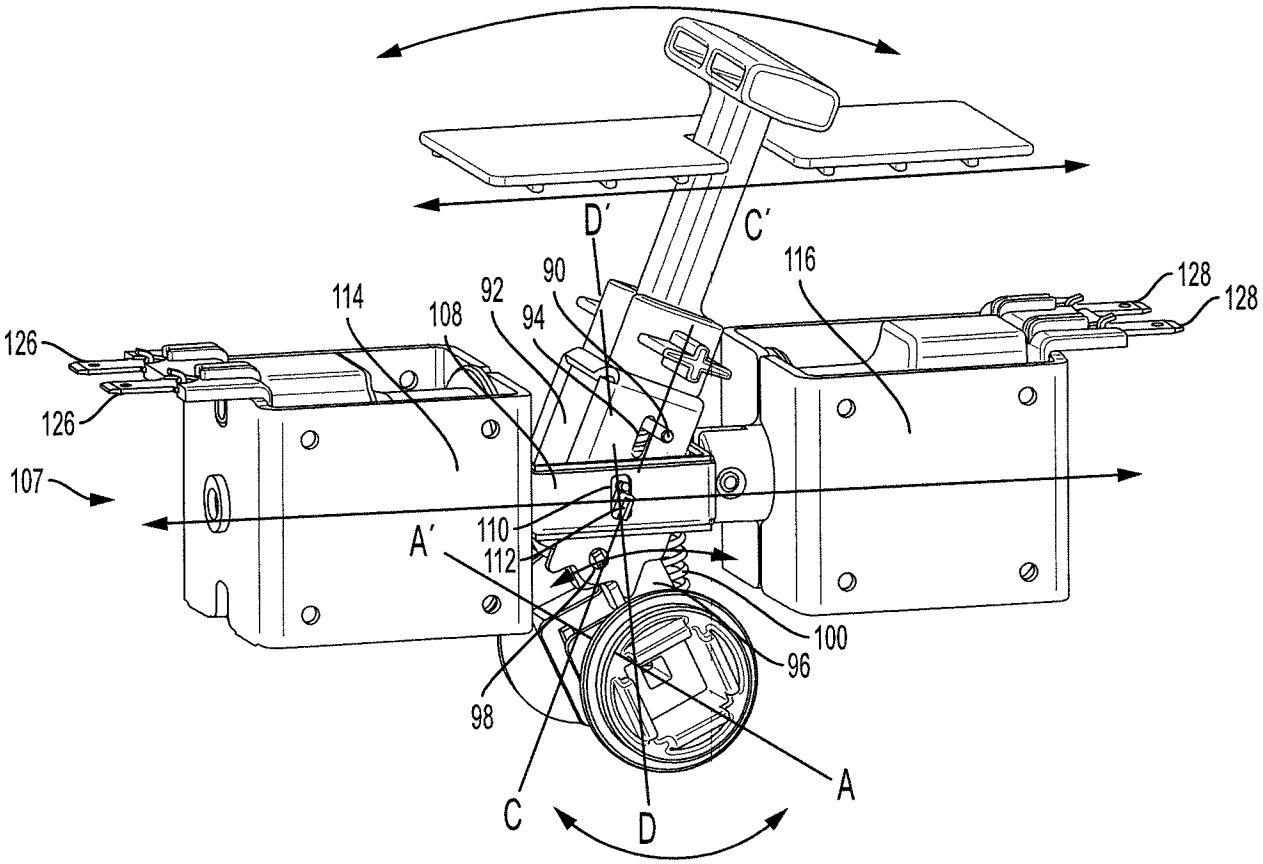
FIG. 25 is a perspective view of internal portions of the actuator that is shown in FIGS. 22 and 24.

Driver 24 includes a radial extension 96 that is pivotally connected to pivot arm 92 by a pin 98. Slot 94 in pivot arm 92 is located at a longitudinal position on pivot arm 92 such that pivot pin 90 of frame 88 extends through slot 94. In this way, pivot arm 92 is pivotal with respect to frame 88 about pin 90. A change in the angular position of pivot arm 92 with respect to frame 88 acts against radial extension 96 of driver 24 to cause the driver to pivot about longitudinal axis A-A'. Changing the angular position of pivot arm 92 in one angular direction causes driver 24 to pivot with respect to frame 88 in the angular direction that is opposite to the angular direction of pivot arm 92. For example, if pivot arm 92 is caused to pivot about pivot pin 90 in a clockwise direction, driver 24 will pivot in a counter-clockwise direction as shown in FIG. 25. Conversely, if pivot arm 92 is caused to pivot about pivot pin 90 in a counter-clockwise direction, driver 24 will pivot in a clockwise direction.

Pivot pin 90 extends through slot 94 in pivot arm 92 so that driver 24 and radial extension 96 are freely pivotal within frame 88. Slot 94 is necessary because as driver 24 changes its angular position within frame 88, radial extension 96 and pivot arm 92 also move with respect to frame 88. Radial extension 96 and pivot arm 92 are pivotally connected by pin 98. However, pivot arm 92 also pivots on pivot pin 90 which is in fixed relationship to frame 88. Locating pivot pin 90 in slot 94 allows pivot pin 90 to travel within slot 94 while pivot arm 92 and radial extension 96 move simultaneously with respect to frame 88. Thus, as pivot arm 92 pivots with respect to frame 88, slot 94 accommodates changes in the dimension between pin 98 (which is moveable with respect to frame 88) and pivot pin 90 (which is fixed with respect to frame 88).

Figure 26:
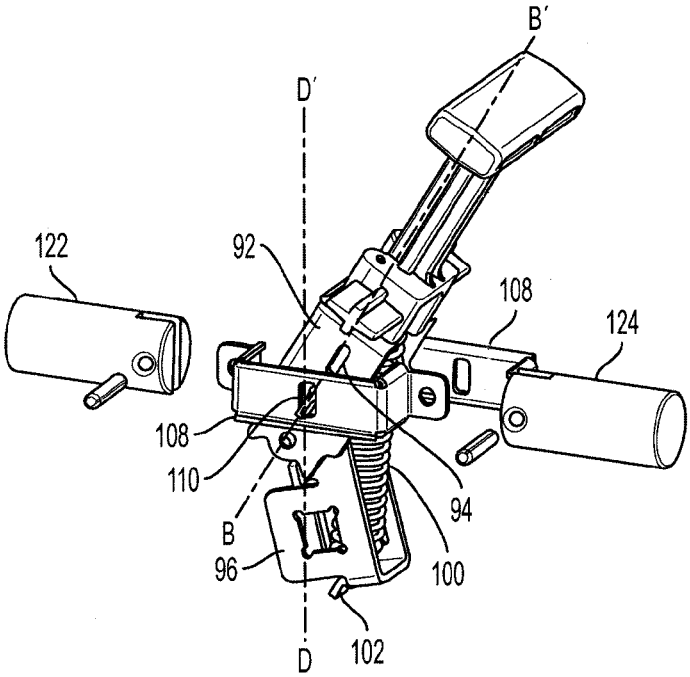
FIG. 26 is a partially exploded perspective view of the latch assembly that is included in the actuator of FIGS. 22, 24 and 25.
Figure 27:
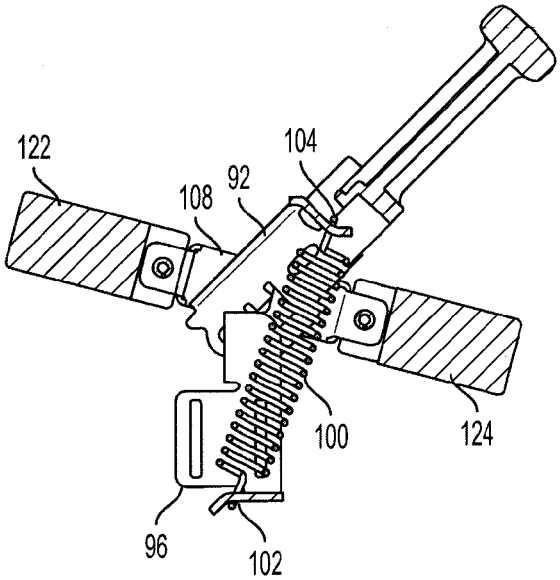
FIG. 27 is a cross-section of the latch assembly that is shown in FIG. 26.
Figure 28:
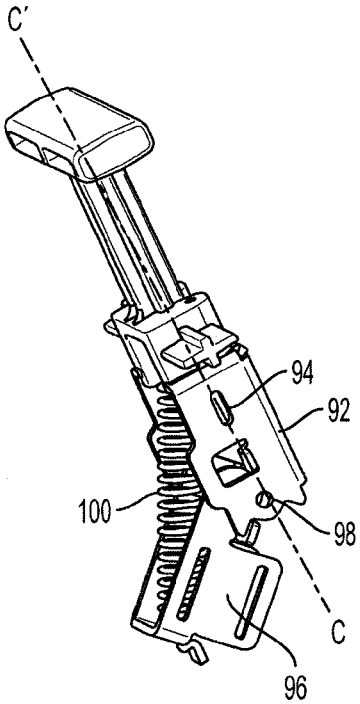
FIG. 28 is a reverse perspective view of portions of the latch assembly that is shown in FIG. 26.
Figure 29:
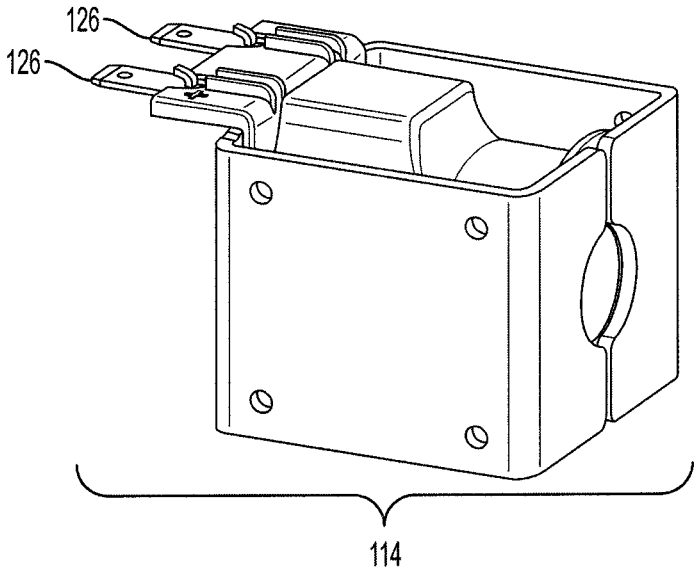
FIGS. 29 and 30 are assembly drawings of the linear motor that is shown in FIGS. 22, 23, 24 and 25.
Figure 30:
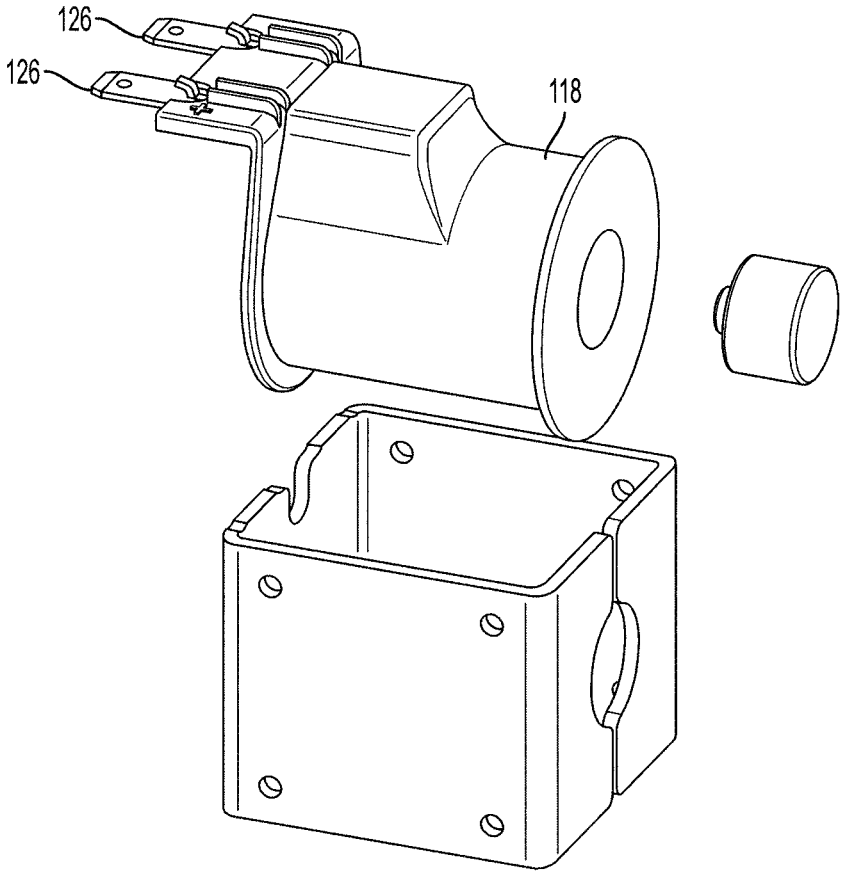
Figure 31:
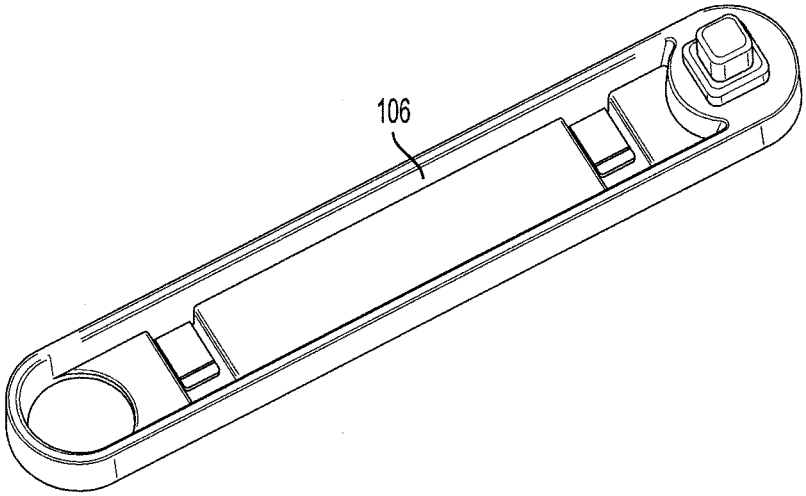
FIG. 31 is a perspective of the handle that is shown in FIGS. 5 and 6.

Actuator 20 further includes an extension spring 100 that has one end 102 that is connected to driver 24. With particular reference to FIGS. 24 and 26, it is shown that in the preferred embodiment end 102 of spring 100 is connected to radial extension 96 of driver 24. FIGS. 24 and 27 show that spring 100 has an opposite end 104 that is connected to pivot arm 92. Extension spring 100 affords increased spring force as ends 102 and 104 are drawn further apart from each other. In pivot arm 92 and driver 24 of FIGS. 20-25, ends 102, 104 are furthest apart at times when pin 98 connecting pivot arm 92 and radial extension 96 is directly above driver 24 which can be referred to as the top dead center angular position. At times when pin 98 is at an angular position on either side of the top dead center position of driver 24, the ends 102, 104 are closer together. Thus the spring force applied by spring 100 is greatest when pin 98 is at the top dead center position and is less when driver 24 is at either end point of the arc defined by the pivotal movement of driver 24. For this reason, energy must be applied to overcome the force of spring 100 when driver 24 moves from either end point of the arc defined by pivotal movement of driver 24 to the top dead center position. As driver 24 passes through the top dead center position and continues in the same angular direction, spring 100 returns energy back to the actuator 20. In this way, spring 100 biases driver 24 toward the end positions of the arc.

In the preferred embodiment of FIGS. 20-28, actuator 20 further includes a linear motor 107 that is connected to a shuttle bracket 108. Shuttle bracket 108 defines a slot 110 and a pin 112 that is connected to pivot arm 92 extends through slot 110 to link pivot arm 92 and shuttle bracket 108. Linear motor 107 moves shuttle bracket 108 between end points that are defined by the limit of travel for linear motor 107. As linear motor 107 moves shuttle bracket 108 between end positions of the line of travel, shuttle bracket 108 causes pivot arm 92 to pivot through an angular motion that corresponds to the movement of shuttle bracket 108.

Figure 22:
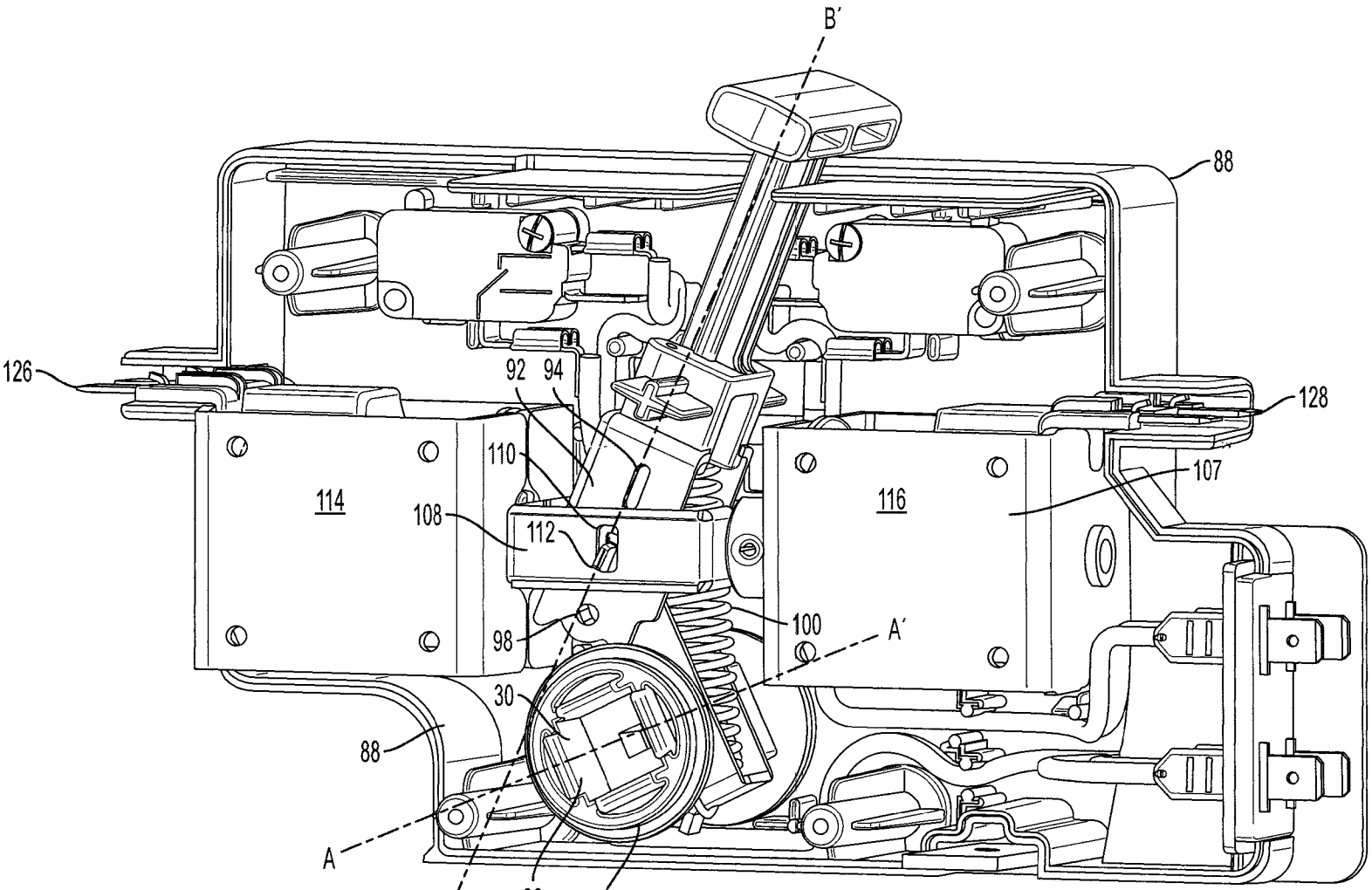
FIG. 22 is a perspective view of the actuator that is shown in FIG. 20 with a portion of the casing removed to better disclose the features therein.
Figure 23:
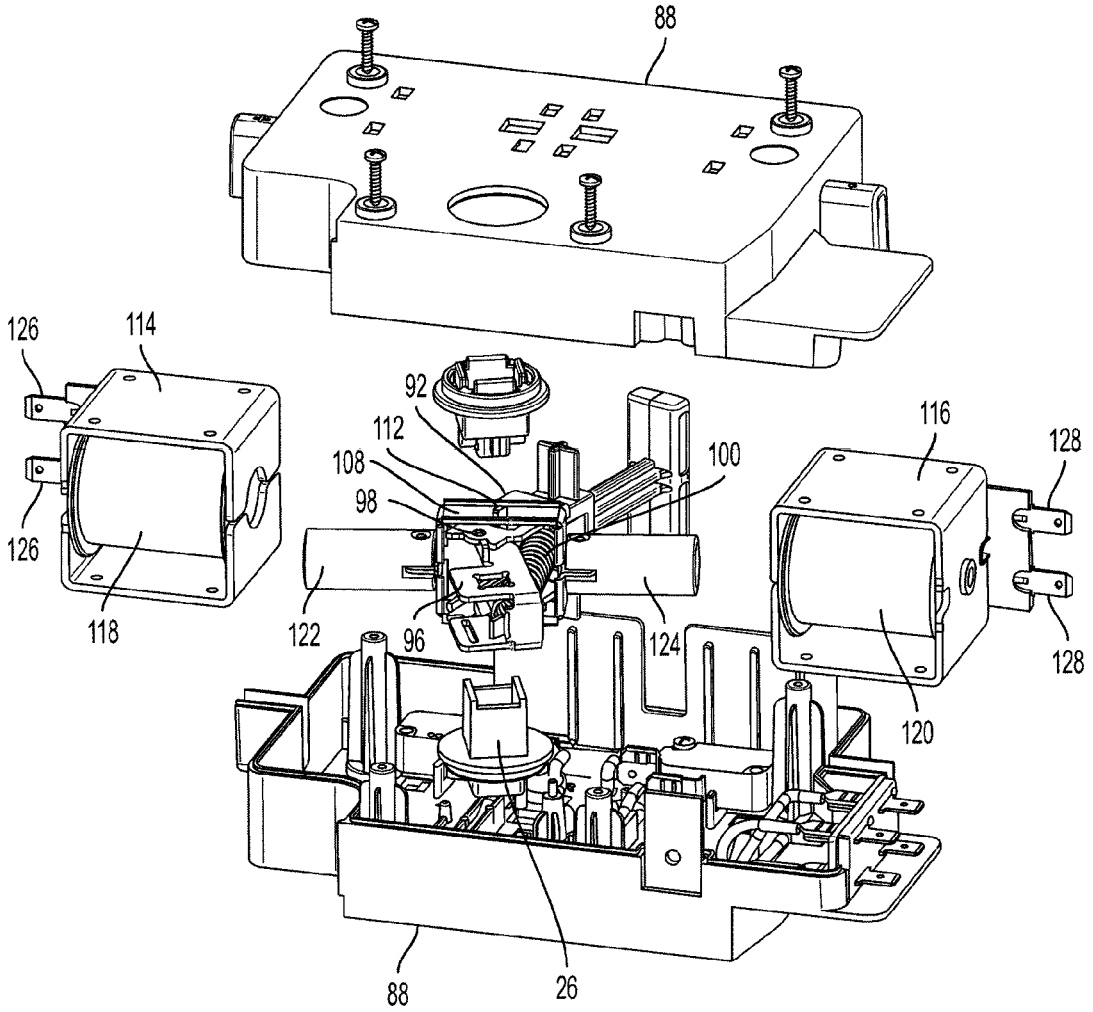
FIG. 23 is a partially exploded perspective view of the actuator shown in FIG. 22 with the actuator oriented on a side.

FIGS. 22-24 show that linear motor 107 includes solenoids 114, 116 that have coils 118, 120 and armatures 122, 124 respectively. When electrical energy is supplied to terminals 126 of coil 118, armature 122 is drawn into coil 118. Similarly, when electrical energy is supplied to terminals 128 of coil 120, armature 124 is drawn into coil 120. Shuttle bracket 108 is connected to armatures 122, 124 so that, by selectively supplying electrical energy to terminals 126 and 128, linear motor 107 can be made to draw shuttle bracket 108 alternatively to the end position of movement of armature 122 and the end position of movement of armature 124.

Linear motor 107 is secured to frame 88 of actuator 20 such that coils 118 and 120 are in fixed position with respect to frame 88 and armatures 122, 124 are moveable along a longitudinal axis that is defined by armatures 122, 124. The line of travel of armatures 122, 124 and shuttle bracket 108 is at a fixed elevation with respect to frame 88. However, pivot arm 92 is pivotally connected at pin 98 to radial extension 96 which rotates with driver 24. As driver 24 and radial extension 96 change angular position with respect to frame 88, pivot arm 92 changes elevation with respect to frame 88. Similar to the dynamic that was previously explained with respect to slot 94 and pivot pin 90, shuttle bracket 108 includes slot 110 to accommodate the change in elevation of pivot arm 92 with the change in angular position of driver 24. This allows driver 24 to pivot freely and in response to the movement of shuttle bracket 108 with respect to frame 88. More specifically, shuttle bracket 108 is provided with slot 110 having a major axis D-D' that is aligned normal to the direction of movement of shuttle bracket 108. At times when driver 24 is pivoted and radial extension 96 causes pivot arm 92 to move vertically with respect to frame 88, pin 112 (that links shuttle bracket 108 and pivot arm 92) t ravels within slot 110 to allow pin 112 to also move vertically and accommodate changes in elevation of pivot arm 92 with respect to frame 88. That is, to allow free movement of pin 98 and driver 24, pin 98 extends through slot 110 and is vertically moveable in slot 110.

FIGS. 32-36 show an alternative embodiment of a contact assembly that may be substituted in transfer switch 22 in place of contact assembly 48. In FIGS. 32-36, a magnetic contact assembly 130 includes a wishbone-shaped contact arm 132 that includes two branches 134, 135. Each of branches 134, 135 supports a respective flat magnet 136, 137 and a respective load contact 138, 139. As particularly shown in FIGS. 34 and 35, contact arm 132 is connected to a spool or drive linkage 140. Similar to drive linkage 26, spool or drive linkage 140 includes a male end 141*a* and a female end 141*b* that engage adjacent transfer switches 22 of a linear array of transfer switches or that engage an adjacent actuator 20 such that spool or drive linkage 140, together with all other spool or drive linkages 140 that are connected through ends 141*a* and 141*b* are controlled by the driver 24 of the actuator.

Figure 33:
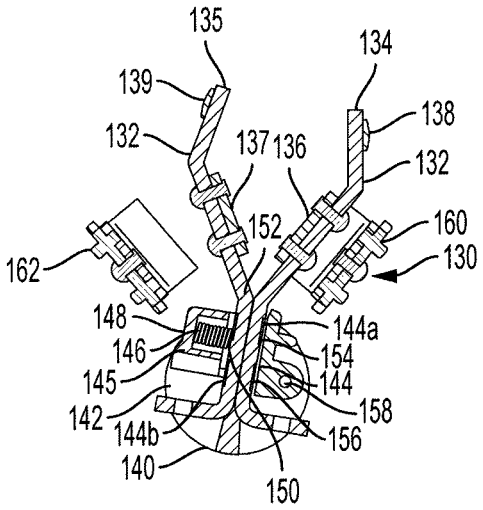
FIG. 33 is a cross-section of the magnetic contact assembly that is shown in FIG. 32.
Figure 34:
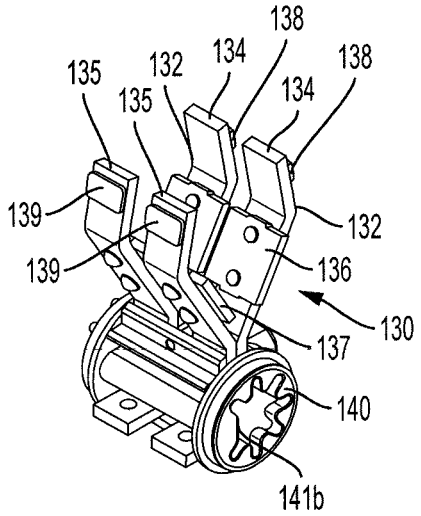
FIGS. 34 and 35 are perspective views of the magnetic contact assembly that is shown in FIGS. 32 and 33.
Figure 35:
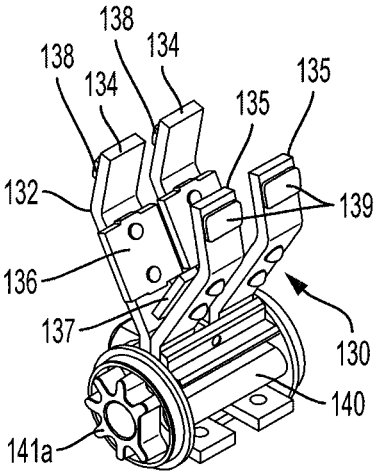
Figure 36:
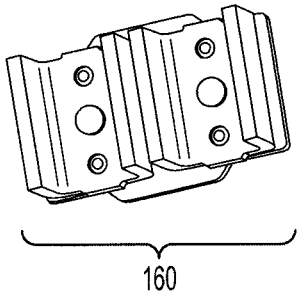
FIG. 36 is a partial drawing of the magnet assembly that is shown in FIGS. 32 and 33.

As particularly shown in FIG. 33, contact arm 132 is connected to a spool or drive linkage 140 by a rocking mounting 142 that includes a holder 144 on one side 144*a* of contact arm 132 and a compression spring 146 on the side 144*b* of contact arm that is transverse to holder 144. One end 145 of compression spring 146 is placed against a holder 148 that is rigidly secured to spool or drive linkage 140. The opposite end 150 of compression spring 146 is placed against the transverse side 144*b* of contact arm 132 so that compression spring urges the base 152 of contact arm 132 against holder 144.

Gaps 154, 156 are provided between the base 152 of contact arm 132 and holder 144. Gaps 154, 156 are separated by a land portion 158 and spring 146 biases base 152 against land portion 158 so that contact arm 132 is stable against holder 144 at times when no external force is applied against load contacts 138, 139. However, at times when sufficient external force is applied against load contacts 138, 139 through torque applied spool or to drive linkage 140 and contact between load contacts 138, 139 and power supply contacts, the external force overcomes the bias force of compression spring 146 against contact arm 132 and causes base 152 of contact arm 132 to rock into one of gaps 154, 156. As viewed in FIG. 33, at times when load contact 138 contacts first source or power contacts 62, 64, (see FIG. 13) magnetic contact assembly 130 rocks in a counter-clockwise direction. At times when load contact 139 contacts second power contacts 66, 68, magnetic contact assembly 130 rocks in a clockwise direction. In this way, rocking mounting 142 allows drive linkage 140 to over-rotate the end points of a pivot arc in which the end points are established by source or supply contacts 62, 64 and 66, 68 so that rocking mounting 142 provides additional force between load contacts 138, 139 and the respective supply contacts in response to the mechanical interference to avoid a blow open condition.

Magnetic contact assembly 130 further includes U-shaped magnets 160, 162 that cooperate with flat magnets 136, 137 respectively to provide additional force between load contacts 138, 139 and respective source or power contacts 62, 64 and 66, 68 through branches 134, 135. More specifically, flat magnets 136, 137 attached to respective branches 134, 135 and U-shaped magnets 160, 162 are not permanent magnets. Rather, they are metal elements that exhibit magnetic effects at times when they conduct electricity between the respective load contacts and source or power contacts. For example, as viewed in FIGS. 32 and 33, as drive linkage 140 rotates in a clockwise direction and load contact 138 comes into proximity with source or supply contacts 62, 64, flat magnet 136 approaches U-shaped magnet 160. At the same time electric current begins to flow through branch 134. Current flow through branch 134 causes magnetic flux in flat magnet 136 and induces magnetic flux in U-shaped magnet 160 so that magnetic force draws flat magnet 136 into U-shaped magnet 160. This magnetic force provides additional force that bears load contact 138 against source or supply contacts 62, 64 and further prevents blow open conditions to occur between load contacts 138 and source or supply contacts 62, 64.

Figure 32:
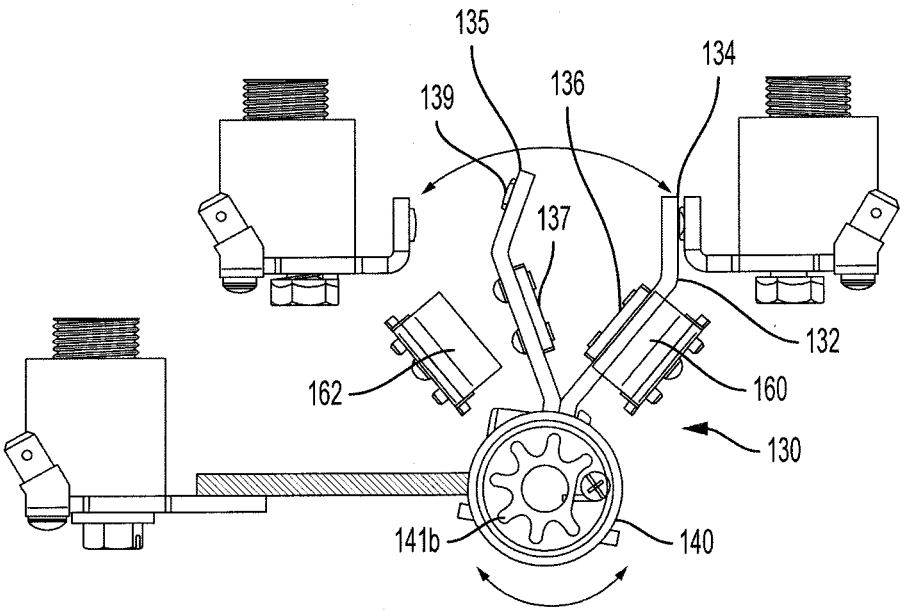
FIG. 32 is a relational drawing showing a magnetic alternative embodiment to the contact assembly that is shown in FIGS. 17 and 18.

Conversely, when drive linkage 140 rotates in a counter-clockwise direction as viewed in FIGS. 32 and 33 and load contact 139 comes into proximity with supply contacts 66, 68, flat magnet 137 approaches U-shaped magnet 162. At the same time electric current begins to flow through branch 135. Current flow through branch 135 causes magnetic flux in flat magnet 137 and induces magnetic flux in U-shaped magnet 162 so that magnetic force draws flat magnet 137 into U-shaped magnet 162. This magnetic force provides additional force that bears load contact 139 against source or supply contacts 66, 68 and further prevents blow open conditions to occur between load contacts 139 and source or supply contacts 66, 68.

It has been found that U-shaped magnets 160, 162 must have a generally U-shaped cross-section that creates channels 166, 168 in magnets 160, 162 so that respective flat magnets 136, 137 respectively nest in such channels. It is believed that the reason for this structure is that the nesting relationship of flat magnets 136, 137 into U-shaped magnets 160, 162 is required to create sufficient magnetic flux to draw flat magnets 136, 137 and U-shaped magnets 160, 162 together with a preferred level of force to overcome blow open conditions.

While a presently preferred embodiment of the disclosed invention is shown and described herein, the disclosed invention is not limited thereto and can be variously otherwise embodied within the scope of the following claims.

We claim:

1. An actuator for controlling the mechanical position of an electrical device, said actuator comprising;

a frame that includes a pivot pin;

a pivot arm that defines a longitudinal axis, said pivot arm having a slot with a major axis that is parallel to the longitudinal axis of said pivot arm;

a rotatable member that is connectable to said electrical device, said rotatable member defining a longitudinal axis and being pivotal about said longitudinal axis with respect to said frame in both clockwise and counter-clockwise directions, said rotatable member having a radial extension with a pivotal connection to said pivot arm, said slot of said pivot arm being at a longitudinal position on said pivot arm such that said pivot pin of said frame extends through said slot of said pivot arm and a change in the angular position of said pivot arm with respect to said frame in one angular direction causes said rotatable member to pivot in an angular direction that is opposite to said one angular direction; and an extension spring having one end that is connected to said rotatable member and having an opposite end that is connected to said pivot arm, said extension spring biasing said pivot arm toward the end positions of the travel of said pivot arm.

2. The actuator of claim 1 wherein the pivot pin of said frame moves in the slot of said pivot arm in accordance with the angular movement of said rotatable member.

3. The actuator of claim 1 wherein the spring force of said extension spring is greater at times when said pivot arm is angularly positioned midway between said first and second positions than the spring force of said extension spring at times when said pivot arm is located at said first end position and at times when said pivot arm is located at said second end position.

4. The actuator of claim 1 wherein said electrical device comprises:

a spool that is connectable to said rotatable member of said actuator, said spool being pivotal in both clockwise and counter-clockwise angular directions;

at least one load contact that is connected to an arm that extends radially from said spool such that said load contact is movable between end points of an arc in response to angular movement of said spool;

at least a first source contact that is located at a given radius and angular position with respect to said spool such that said first source contact engages said load contact at times when said spool is in a first angular position;

at least a second source contact that is located at a given radius and angular position with respect to said spool such that said second source contact engages said load contact at times when said spool is in a second angular position; and at least two compression springs that are located on opposite sides of said arm that extends radially from said spool, one of said compression springs being compressed at times when said spool is in said first position and the second of said compression springs being compressed at times when said spool is in said second position.

5. The apparatus of claim 4 wherein the compression spring that is located on the side of said arm that is located transversely from said first source contact is in compression at times when said load contact is in contact with said first source.

6. The apparatus of claim 4 wherein the compression spring that is located on the side of said arm that is located transversely from said second source contact is in compression at times when said load contact is in contact with said second source.

7. An actuator for controlling the mechanical position of an electrical device, said actuator comprising:

a frame that includes a pivot pin;

a linear motor that is secured in fixed relationship to said frame; said linear motor having at least one armature that moves linearly between a first end position and a second end position;

a shuttle bracket that is connected to said at least one armature of said linear motor, said linear motor moving said shuttle bracket between first and second positions with respect to said frame in response to the movement of said at least one armature, said shuttle bracket having a slot that defines a major axis that is oriented in a direction that is normal to the direction between said first and second positions of said shuttle bracket;

a pivot arm having at least one pin that extends through the slot in said shuttle bracket, said pivot arm defining a longitudinal axis and having a slot with a major axis that is parallel to the longitudinal axis of said pivot arm;

a rotatable member that connects to said electrical device, said rotatable member defining a longitudinal axis and being pivotal about said longitudinal axis in both clockwise and counter-clockwise directions, said rotatable member having a radial extension with a pivotal connection to said pivot arm, said slot of said pivot arm being at a longitudinal position on said pivot arm such that said slot of said pivot arm is oppositely disposed from said pivot pin of said frame such that a change in the angular position of said pivot arm with respect to said frame in one angular direction causes said rotatable member to pivot in an angular direction that is opposite to said one angular direction; and an extension spring having one end that is connected to said rotatable member and having an opposite end that is connected to said pivot arm, said extension spring biasing said pivot arm in one position at times when said shuttle bracket is in said first position, said extension spring biasing said pivot arm in a second position at times when said shuttle bracket is in said second position.

8. The actuator of claim 7 wherein said linear motor comprises first and second solenoids that are connected to said shuttle bracket and that cooperate to move said shuttle bracket between said first and second positions.

9. The actuator of claim 7 wherein the pin of said pivot arm moves in the slot of said shuttle bracket as in accordance with angular movement of said rotatable member.

10. The actuator of claim 7 wherein the pivot pin of said frame moves in the slot of said pivot arm in accordance with the angular movement of said rotatable member.

11. The actuator of claim 7 wherein the spring force of said extension spring is greater at times when said pivot arm is angularly positioned midway between said first and second positions than the spring force of said extension spring at times when said pivot arm is located at said first end position and at times when said pivot arm is located at said second end position.

12. The actuator of claim 7 wherein said electrical device comprises:

a spool that is pivotal in both clockwise and counter-clockwise angular directions;

at least one load contact that is connected to said spool such that said load contact is movable between end points of an arc in response to angular movement of said spool;

at least a first source contact that is located at a given radius and angular position with respect to said spool such that said first source contact engages said load contact at times when said spool is in a first angular position;

at least a second source contact that is located at a given radius and angular position with respect to said spool such that said second source contact engages said load contact at times when said spool is in a second angular position; and at least two compression springs that are located on opposite sides of said at least one load contact, one of said compression springs being compressed at times when said spool is in said first position and the second of said compression springs being compressed at times when said spool is in said second position.

13. The apparatus of claim 12 wherein the compression spring that is located on the side of said load contact that is located transversely from said first source contact is in compression at times when said load contact is in contact with said first source.

14. The apparatus of claim 12 wherein the compression spring that is located on the side of said load contact that is located transversely from said second source contact is in compression at times when said load contact is in contact with said second source.

15. An electrical switch comprising:

a spool that is pivotal in both clockwise and counter-clockwise angular directions;

at least one load contact that is connected to said spool such that said load contact is movable between end points of an arc in response to angular movement of said spool;

at least a first source contact that is located at a given radius and angular position with respect to said spool such that said first source contact engages said load contact at times when said spool is in a first angular position;

at least a second source contact that is located at a given radius and angular position with respect to said spool such that said second source contact engages said load contact at times when said spool is in a second angular position; and at least two compression springs that are located on opposite sides of said at least one load contact, one of said compression springs being compressed at times when said spool is in said first position and the second of said compression springs being compressed at times when said spool is in said second position.

16. The apparatus of claim 15 wherein the compression spring that is located on the side of said load contact that is located transversely from said first source contact is in compression at times when said load contact is in contact with said first source.

17. The apparatus of claim 15 wherein the compression spring that is located on the side of said load contact that is located transversely from said second source contact is in compression at times when said load contact is in contact with said second source.

18. An electrical switch comprising:

a spool that is pivotal in both clockwise and counter-clockwise angular directions;

at least one load contact that is connected to said spool such that said load contact is movable between end points of an arc in response to angular movement of said spool;

at least a first source contact that is located at a given radius and angular position with respect to said spool such that said first source contact engages said load contact at times when said spool is in a first angular position;

at least a second source contact that is located at a given radius and angular position with respect to said spool such that said second source contact engages said load contact at times when said spool is in a second angular position; and a contact arm that is connected to said load contact and that is also connected to said spool such that said contact arm moves in an arc in response to the pivotal movement of said spool with said arc having a first end point at times when said spool is pivoted to an end point in one angular direction and said arc having a second end point at times when said spool is pivoted to an end point in the opposite angular direction, said contact arm being biased by a contact assembly that produces a bias force between one of said load contacts and an opposing power contact at times when the angular position of said spool is between the angular position for contact between the load contact and an opposing power contact and the end point of the pivot arc of said spool, said contact assembly including at least two compression springs that are located on opposite sides of said at least one load contact, one of said compression springs being compressed at times when said spool is in said first position and the second of said compression springs being compressed at times when said spool is in said second position.

19. The apparatus of claim 18 wherein the compression spring that is located on the side of said load contact that is located transversely from said first source contact is in compression at times when said load contact is in contact with said first source.

20. The apparatus of claim 18 wherein the compression spring that is located on the side of said load contact that is located transversely from said second source contact is in compression at times when said load contact is in contact with said second source.

21. An electrical switch comprising:

a spool that is pivotal in both clockwise and counter-clockwise angular directions;

at least one load contact that is connected to said spool such that said load contact is movable between end points of an arc in response to angular movement of said spool;

at least a first source contact that is located at a given radius and angular position with respect to said spool such that said first source contact engages said load contact at times when said spool is in a first angular position;

at least a second source contact that is located at a given radius and angular position with respect to said spool such that said second source contact engages said load contact at times when said spool is in a second angular position; and a contact arm that is connected to said load contact and that is also connected to said spool such that said contact arm moves in an arc in response to the pivotal movement of said spool with said arc having a first end point at times when said spool is pivoted to an end point in one angular direction and said arc having a second end point at times when said spool is pivoted to an end point in the opposite angular direction, said contact arm being biased by a contact assembly that produces a bias force between one of said load contacts and an opposing power contact at times when the angular position of said spool is between the angular position for contact between the load contact and an opposing power contact and the end point of the pivot arc of said spool, said contact assembly including at least two flat magnets that are connected to said contact aim and at least two U-shaped magnets, said flat magnets cooperating with said respective ones of said U-shaped magnets at times when said load contact is in contact with one of said power contacts to produce an attractive force between said flat magnet and said U-shaped magnet at times in response to electrical current flow in said contact arm.

22. The electrical switch of claim 21 wherein said contact arm defines first and second branches and wherein each of said flat magnets is attached to a respective branch of said contact arm.

23. The electrical switch of claim 22 wherein said contact arm is connected to said spool by a rocking mounting wherein said spool includes a holder and a compression spring and wherein said holder and said compression spring oppose transverse sides of said contact arm.

24. The electrical switch of claim 23 wherein said rocking mounting further defines at least one gap between said rocking mounting and said contact arm and at least one land between said rocking mounting and said gap such that the gap between said rocking mounting and said contact arm closes at times when said spool is at an angular position between the angular position corresponding to contact between said load contact and said power contact and the end point of the arc of rotation of said spool.

* * * * *